US006882806B2

(12) United States Patent
Sunahara et al.

(10) Patent No.: US 6,882,806 B2
(45) Date of Patent: Apr. 19, 2005

(54) CHARGING APPARATUS DETERMINING A PEAK-TO-PEAK VOLTAGE TO BE APPLIED TO A CHARGING MEMBER

(75) Inventors: Satoshi Sunahara, Shizuoka-ken (JP); Keiji Okano, Shizuoka-ken (JP); Satoru Motohashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/405,467

(22) Filed: Apr. 3, 2003

(65) Prior Publication Data

US 2003/0219268 A1 Nov. 27, 2003

(30) Foreign Application Priority Data

Apr. 9, 2002 (JP) ..... 2002/106339
Apr. 9, 2002 (JP) ..... 2002/106340

(51) Int. Cl.[7] ..... G03G 15/02
(52) U.S. Cl. ..... 399/50; 399/176
(58) Field of Search ..... 399/43, 44, 50, 399/168, 174, 175, 176

(56) References Cited

U.S. PATENT DOCUMENTS

| | | | | |
|---|---|---|---|---|
| 4,326,796 A | * | 4/1982 | Champion et al. | 399/50 X |
| 4,851,960 A | | 7/1989 | Nakamura et al. | 361/225 |
| 5,420,671 A | | 5/1995 | Kisu et al. | |
| 5,457,522 A | * | 10/1995 | Haneda et al. | 399/176 |
| 5,589,918 A | | 12/1996 | Oshida et al. | 399/114 |
| 5,606,399 A | * | 2/1997 | Kikui | 399/168 |
| 5,636,009 A | * | 6/1997 | Honda et al. | 399/50 |
| 5,682,574 A | | 10/1997 | Oshida et al. | 399/64 |
| 5,749,022 A | * | 5/1998 | Kikui et al. | 399/50 |
| 5,812,905 A | | 9/1998 | Yoo | 399/50 |
| 6,122,460 A | * | 9/2000 | Meece et al. | 399/176 X |
| 6,128,462 A | | 10/2000 | Kato et al. | 399/350 |
| 6,175,703 B1 | | 1/2001 | Nakazono et al. | 399/111 |
| 6,332,064 B1 | | 12/2001 | Sato et al. | 399/50 |
| 6,343,193 B1 | | 1/2002 | Matsumoto et al. | 399/27 |
| 6,532,030 B2 | | 3/2003 | Okano et al. | 347/131 |
| 2001/0019669 A1 | | 9/2001 | Watanabe et al. | 399/50 |

FOREIGN PATENT DOCUMENTS

| | | |
|---|---|---|
| EP | 0 520 819 | 12/1992 |
| JP | 63-149669 | 6/1988 |
| JP | 9-190143 | 7/1997 |
| JP | 11-258957 | 9/1999 |

* cited by examiner

*Primary Examiner*—Sandra L. Brase
(74) *Attorney, Agent, or Firm*—Fitzpatrick, Cella, Harper & Scinto

(57) ABSTRACT

A charging apparatus includes a charging member, contactably provided to a member to be charged, for charging the member to be charged; a voltage application device for applying alternating voltages having different peak-to-peak voltages to the charging member; and a determination device for determining a peak-to-peak voltage to be applied to the charging member with respect to a second area of the member to be charged, on the basis of a peak-to-peak voltage corresponding to a minimum current which is not less than a predetermined current of alternating currents through the member to be charged when the alternating voltages having the different peak-to-peak voltages are applied to the charging member with respect to a first area of the member to be charged.

13 Claims, 19 Drawing Sheets

CHARGING APPARATUS DETERMINING A PEAK-TO-PEAK VOLTAGE TO BE APPLIED TO A CHARGING MEMBER

FIELD OF THE INVENTION AND RELATED ART

The present invention relates to a charging apparatus suitable for use in an image forming apparatus which adopts electrophotography, electrostatic recording, etc.

FIG. 13 shows a schematic sectional view of an embodiment of an ordinary image forming apparatus.

The image forming apparatus in this embodiment is an electrophotographic copying machine or printer.

Referring to FIG. 13, the image forming apparatus includes a rotation drum-type electrophotographic photosensitive member 100 as a member to be charged (latent image bearing member) (hereinafter referred to as a "photosensitive drum"). The photosensitive drum 100 is rotationally driven in a direction of an arrow at a predetermined peripheral speed, charged uniformly to a predetermined polarity and a predetermined potential by a charging apparatus 101 during the rotation, and then is subjected to imagewise exposure by an exposure apparatus 102. As a result, an electrostatic latent image is formed on the photosensitive-drum surface, and then is developed by a developing apparatus 103 with a toner to be visualized as a toner image. The toner image formed on the photosensitive-drum surface is transferred onto a recording medium 104, such as paper, supplied from an unshown paper-supply portion, by a transfer apparatus 105. The recording medium 104, after the toner image is transferred thereon, is separated from the photosensitive-drum surface and introduced into a fixing apparatus 106 by which the toner image is fixed to be and then discharged as an image formed product. The photosensitive-drum surface after separation of the recording medium is cleaned by scraping a transfer residual toner by a cleaning apparatus 107, and is repetitively subjected to image formation.

As described above, image formation is performed by repeating the steps of charging, exposure, development, transfer, fixation and cleaning through the above-mentioned means of the image forming apparatus.

As the charging apparatus 101, those using a contact-charging scheme wherein a roller- or blade-type charging member is caused to contact the photosensitive-drum surface while applying a voltage to the contact-charging member to charge the photosensitive-drum surface have been widely used. Particularly, the contact-charging scheme using a roller-type charging member (charging roller) allows a stable charging operation for a long period.

To the charging roller as the contact-charging member, a charging-bias voltage is applied from a charging-bias-application means. The charging-bias voltage may consist only of a DC voltage, but may include a bias voltage, as described in Japanese Laid-Open Patent Application (JP-A) Sho 63-149669, comprising a DC voltage Vdc corresponding to a desired dark-part potential Vd on a photosensitive drum biased or superposed with an AC voltage having a peak-to-peak voltage (Vpp) which is at least twice a discharge-start voltage at the time of application of the DC voltage Vdc.

This charging scheme is excellent in uniformly charging the photosensitive-drum surface and obviates a local potential irregularity on the photosensitive drum by applying a voltage comprising a DC voltage biased with an AC voltage. The resultant charging voltage Vd uniformly converges at the applied DC voltage value Vdc.

However, this scheme increases the amount of discharged electrical charges when compared with the case of applying only the DC voltage component as the charging-bias voltage, thus being liable to accelerate the surface deterioration such that the photosensitive-drum surface is worn by abrasion between the photosensitive-drum surface and the cleaning apparatus. In order to prevent such a surface deterioration, the charging roller has been required to prevent excessive discharge against the photosensitive drum by suppressing the AC peak-to-peak voltage Vpp of the charging-bias voltage.

However, the relationship between the AC peak-to-peak voltage (Vpp) and the amount of discharged electrical charges is not always constant, since it changes depending on the thickness of a photosensitive layer at the photosensitive-drum surface, operating environmental conditions, etc.

For example, even when an identical peak-to-peak voltage is applied to a charging roller, the impedance of the charging roller is increased in an environment of low-temperature and low-humidity to lower the amount of discharged electrical charges. On the other hand, in an environment of high-temperature and high-humidity under which the impedance is decreased, the amount of discharged electric charges is increased. Further, even in an identical operation environment, when the photosensitive-drum surface is abraded due to wearing by the use thereof, the resultant impedance is lowered compared with that at an initial stage, thus resulting in a larger amount of discharged electrical charges.

In order to eliminate the problem, a method of controlling an AC component with a constant current has been proposed (U.S. Pat. No. 5,420,671). According to this method, an alternating current Iac passing through the photosensitive drum (photosensitive member) is detected and controlled so as to be constant. As a result, the peak-to-peak voltage varies freely depending on the change in impedance due to environmental variation or abrasion of the photosensitive drum, so that it is possible to always keep the amount of discharged electrical charges substantially constant, irrespective of environmental changes, the film thickness of photosensitive drum, etc.

Further, U.S. Patent Publication No. 2001-19669 has disclosed a method wherein an AC voltage allowing an appropriate discharge amount and obtained by detecting an alternating current Iac passing through a photosensitive drum when an alternating peak-to-peak voltage Vpp is applied to a charging apparatus at the time of non-image formation with respect to a discharged area and a non-discharge area and calculating the amount of discharge current based on the relationship between the Iac values with respect to the discharged and non-discharge areas, is used as a charging bias. According to this method, the discharge current is further directly controlled, so that it becomes possible to control the discharge current with high accuracy compared with the conventional constant current control.

The above-mentioned methods bring about the effect of ensuring an increased life of the photosensitive drum and a good chargeability.

Further, JP-A HEI 09-190143 has disclosed a method wherein a process cartridge is provided with a means for detecting and storing the operating time of the process cartridge and an alternating peak-to-peak voltage is set to provide at least two species of constant-voltage outputs to estimate the film thickness of a photosensitive drum, thus reducing the alternating peak-to-peak voltage in stages.

In the case where the AC component is controlled with a constant voltage, a DC voltage can be generated by connecting a step-up transformer for AC output (voltage-increase means) T-AC with a capacitor C for DC-voltage generation via a diode D and fully charging the capacitor, as shown in FIG. 14A, so that it becomes possible to output a superposed bias of a DC voltage biased with an AC voltage by using only the single voltage-increase means T-AC.

For this reason, it is not necessary to use a DC power supply and an AC power-supply in combination, so that a power-supply circuit is remarkably simplified compared with the case of constant-current control. As a result, the power-supply circuit brings about advantages in terms of cost-reduction and space spacing thereof.

Further, after the process cartridge is mounted, as described in JP-A HEI 11-258957, detection of the presence or absence of the process cartridge is performed by applying a charging bias to a photosensitive drum via a contact-charging member in some cases. More specifically, the value of an alternating current passing through the photosensitive drum and the charging member is detected at the time of charging-bias application, and if the current value is at most a certain value, notification of the absence of the process cartridge is made.

In the case where a process cartridge, including at least a photosensitive drum and a contact-charging means are detachably mounted to an image forming apparatus, is employed, it is not uncommon for the image-forming-apparatus body that is used to be replaced during use by another one, which is then used. At that time, the apparatus may preferably be designed so as not to cause charging failure in any combination of the process cartridge and the apparatus body and so as not to apply an excessively large bias.

As described above, in order to control the amount of discharged electrical charges to be substantially constant irrespective of the usage pattern, it is possible to adopt the AC constant-current control method as described in U.S. Pat. No. 5,420,671 or the discharge-amount calculation method as described in U.S. Patent Publication No. 2001-19669. However, in these methods, when a superposed voltage of AC and DC is outputted from a single voltage-increase means T-AC as shown in FIG. 14A, a capacitor cannot be charged fully in a high-temperature and high-humidity condition or at a later stage of image formation, lowering the alternating peak-to-peak voltage, and thus failing to provide a desired DC voltage. As a result, a good charging of the photosensitive drum is not preformed, which can cause difficulties such as the occurrence of charging failure.

For this reason, in the case of using the above methods, there is a limit to the output of the superposed voltage of AC and DC by the single voltage-increase means. Accordingly, in order to obtain a stable charging-bias voltage, as shown in FIG. 14B, an DC power supply T-DC and an AC power supply are disposed separately thus requiring mounting of two voltage-increase means for DC and AC.

However, the voltage-increase means not only is expensive, but also has a large size within a charge-generation circuit. As a result, in a small-sized and reduced-cost image forming apparatus, it is desirable that a stable charging-bias voltage is outputted from a single voltage-increase means in view of the deisirability to provide a space saving and reduced-cost power-supply circuit. On the other hand, another problem, such that the power-supply circuit is liable to be affected by the irregularity in bias of the apparatus body, the impedance of the charging member, the film thickness of the photosensitive drum, etc., also arises.

In the method described in JP-A HEI 09-190143, it is possible to constitute a charging-bias generation circuit by a single voltage-increase means, thereby providing considerable advantages in terms of space saving and cost reduction. However, in the method, a voltage-switching operation (a decrease in alternating peak-to-peak voltage) is performed at a predetermined timing (when the photosensitive drum is used for a predetermined time). As a result, e.g., the voltage-switching operation is performed based on power-supply tolerance etc., of the charging-bias generation circuit even if the amount of discharged electrical charges is in an appropriate range when the output of the peak-to-peak voltage is a lower limit of the tolerance, thereby resulting in an insufficient discharge amount to cause charging failure in some cases. On the other hand, when the output of the peak-to-peak voltage is an upper limit of the tolerance, it is conceivable that voltage switching cannot be performed until the predetermined timing, even though the discharge amount is excessive, thus accelerating wearing and abrasion of the photosensitive drum. As a result, the method is inferior in accuracy of discharge control to the above-described constant-current control method. The above problems can be solved by reducing the electrical resistance of the charging apparatus and/or a power-supply tolerance of the charging-bias generation circuit but a smaller power-supply tolerance is undesirable in view of yields.

In view of these circumstances, it has been desired to perform charge control capable of causing no charging failure and keeping the degree of the wearing of the photosensitive member (drum) to a minimum even if a simple power-supply circuit capable of outputting a superposed bias of AC and DC by a single voltage increase means is employed.

SUMMARY OF THE INVENTION

An object of the present invention is to provide a charging apparatus capable of performing an appropriate charge control.

Another object of the present invention is to provide a charging apparatus capable of suppressing abrasion of a member to be charged.

Another object of the present invention is to provide a charging apparatus capable of performing good charging, irrespective of the ambient environment and abrasion of a member to be charged.

Another object of the present invention is to provide a charging apparatus capable of saving space and reducing the cost of a voltage-application means.

Another object of the present invention is to provide a charging apparatus capable of effecting an appropriate charge control such that charging failure is not caused to occur, nor does the amount of discharged electrical charges become excessively large, immediately after a process cartridge is mounted to an apparatus main body, irrespective of the specific combination of the process cartridge and the image forming apparatus.

According to the present invention, there is provided a charging apparatus, comprising:

a charging member, contactably provided to a member to be charged, for charging the member to be charged, voltage-application means for applying alternating voltages having different peak-to-peak voltages to the charging member, and determination means for determining the peak-to-peak voltage to be applied to the charging member with respect to a second area of the member to be charged, on the basis of a peak-to-peak voltage corresponding to a minimum current which is not less than a predetermined current of alternating currents through the member to be charged when the alternating voltages having the different peak-to-peak voltages are applied to the charging member with respect to a first area of the member to be charged.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

<Embodiment 1>

This embodiment is characterized in that an image forming apparatus includes at least a charging-bias-generation circuit having an alternating oscillation output capable of outputting a superposed voltage of AC and DC by a single voltage-increase means and at least two species of alternating peak-to-peak voltages, and includes an AC current-detection means for detecting an alternating current passing through a photosensitive member (drum) at the time of charging-bias application, wherein the AC current-detection means detects an alternating current Iac passing through the photosensitive drum under the application of at least two species of alternating peak-to-peak voltages when power is turned on or an image is not formed and feeds back the detected alternating currents Iac into an engine controller to select a voltage level in an area allowing ideal discharge as a charging-bias voltage at the time of printing, and the selected charging-bias voltage is applied at the time of image formation.

(1) Configuration and Operation of Image Forming Apparatus

Figure 1:
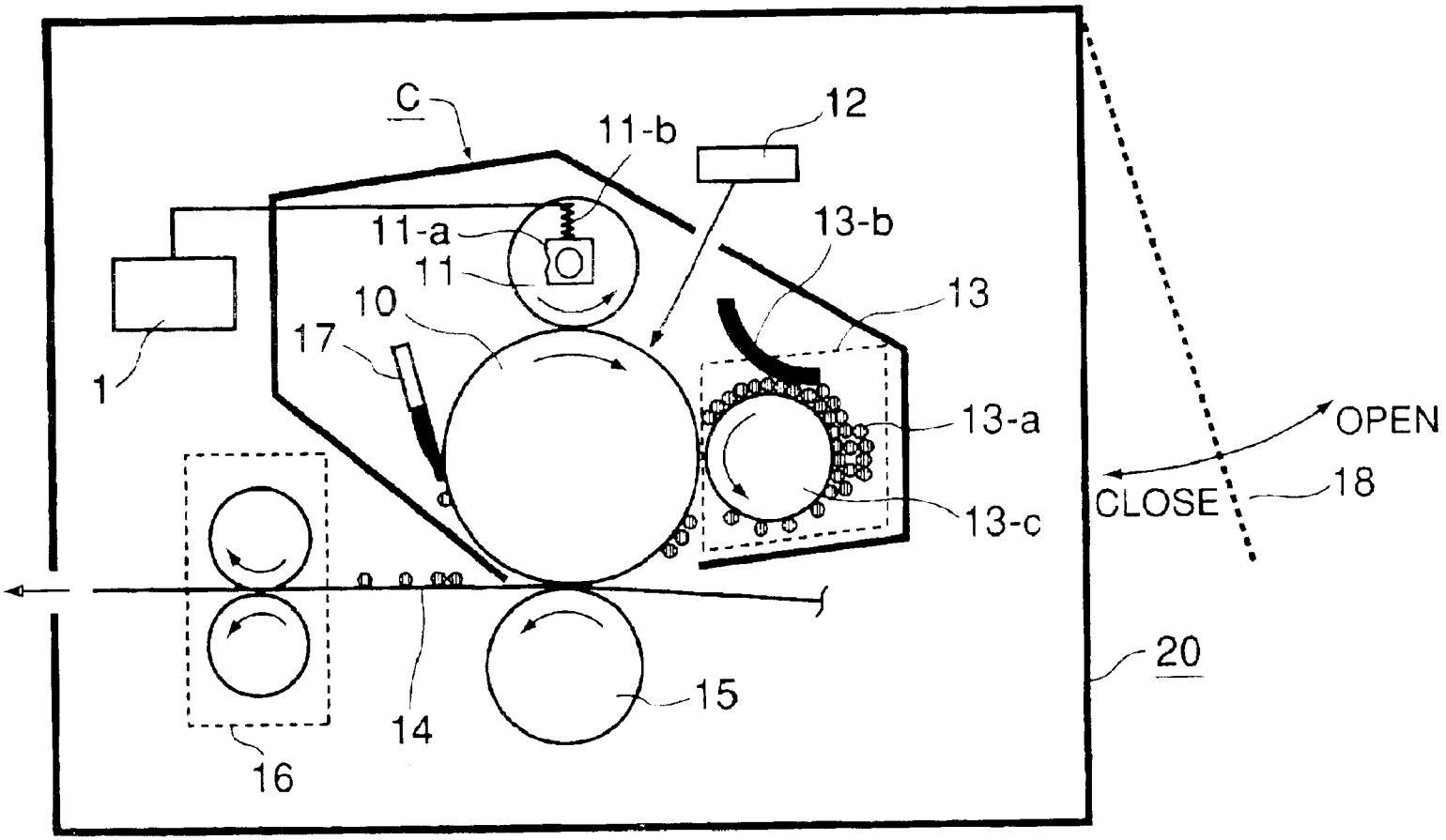
FIG. 1 is a schematic sectional view showing an image forming apparatus used in Embodiment 1 according to the present invention described hereinafter.

FIG. 1 is a schematic sectional view of an image forming apparatus according to this embodiment. The image forming apparatus is a laser-beam printer of electrophotographic and detachable process-cartridge schemes.

Referring to FIG. 1, the image forming apparatus includes a rotation drum-type electrophotographic photosensitive member (photosensitive drum) as an image bearing member being a member to be charged. In this embodiment, the photosensitive drum 10 is a negatively chargeable organic photosensitive member and is rotationally driven by an unshown drive motor in a clockwise direction of an arrow at a predetermined peripheral speed. During the rotation, the photosensitive drum 10 is uniformly charged to a predetermined negative potential by a charging apparatus. The charging apparatus is a contact-type charging apparatus using a charging roller 11 as a charging member.

The charging roller 11 is rotatably supported by electroconductive bearings 11-*a* at both ends thereof and is pressed toward a center direction of the photosensitive drum 10 by a pressing means, such as a pressure spring 11-*b*, so that the charging roller 11 is rotated, mating with the photosensitive drum 10. To the charging roller 1, a bias voltage is applied from a charging-bias-power supply 1 via the pressure spring 1-*b* and the bearings 11-*a*. The charging-bias voltage is applied in accordance with a superposition-application scheme wherein an AC voltage having a peak-to-peak voltage (Vpp) which is at least twice a discharge-start voltage is superposed or biased with a DC voltage Vdc corresponding to a desired surface potential Vd on the photosensitive drum. This charging method is designed to uniformly charge the photosensitive-drum surface to the potential Vd identical to the applied DC voltage Vdc by applying the DC voltage biased with the AC voltage.

Then, the photosensitive drum 10 is subjected to imagewise exposure to light by an exposure apparatus 12. The exposure apparatus 12 is designed to form an electrostatic latent image on the uniformly charged surface of the photosensitive drum 10 and comprises a semiconductor laser-beam scanner in this embodiment. The exposure apparatus 12 outputs a laser light modulated in correspondence with a picture (image) signal sent from a host apparatus (not shown) within the image forming apparatus and effects scanning exposure (imagewise exposure) of the uniformly charged surface of the photosensitive drum 10 through an exposure window of a process cartridge C (described later). On the photosensitive-drum surface, the absolute value at the exposure position becomes lower than that of the charging potential, whereby an electrostatic latent image, depending on image data, is successively formed.

Thereafter, the electrostatic latent image is developed by a reversal developing apparatus 13 to be visualized as a toner image. The developing apparatus 13 is designed to visualize the electrostatic latent image by developing the latent image on the photosensitive drum 10 with a toner 13-*a* as a developer (reversal development). In this embodiment, a jumping-development scheme is employed. According to this development scheme, by applying a developing-bias voltage comprising a superposed voltage of AC and DC from an unshown developing-bias power supply to a developing sleeve 13-*c*, the electrostatic latent image formed on the photosensitive-drum surface is reverse-developed with the toner 13-*a* negatively charged by triboelectrification at the contact portion of the developing sleeve 13-*a* with a developer-layer thickness-regulation member 13-*b*.

The toner image on the photosensitive-drum surface is transferred onto a recording medium (transfer material), such as paper, supplied from a paper-supply unit (not shown), by a transfer apparatus. The transfer apparatus used in this embodiment is of a contact-transfer type and comprises a transfer roller 15. The transfer roller 15 is pressed toward the center direction of the photosensitive drum 10 by a pressing means (not shown), such as a pressure spring. When a transfer step is initiated by carrying the transfer material 14, a positive transfer-bias voltage is applied from an unshown transfer-bias power supply to the transfer roller 15, whereby the negatively charged toner on the photosensitive-drum surface is transferred onto the transfer material 14.

The transfer material 14 subjected to the toner-image transfer is separated from the photosensitive-drum surface to be introduced into a fixing apparatus 16, where the toner image is fixed thereon and then the transfer material 14 is discharged outside the image forming apparatus main body. The fixing apparatus 16 permanently fixes the toner image transferred onto the transfer material 14 by means of heat or pressure.

The photosensitive-drum surface after separation of the transfer material is cleaned by scraping a transfer residual toner by a cleaning apparatus 17 using a cleaning blade. The cleaning blade is designed to recover the transfer residual toner which has not been transferred from the photosensitive drum 10 to the transfer material 14 in the transfer step, and abuts against the photosensitive drum 10 at a certain pressure to recover the transfer residual toner, thus cleaning the photosensitive-drum surface. After completion of the cleaning step, the photosensitive-drum surface is again subjected to the charging step.

The image forming apparatus performs image formation by repeating the above-mentioned respective steps of charging, exposure, development, transfer, fixation and cleaning, with the above-mentioned means, respectively.

In this embodiment, the process cartridge C is replaceably and detachably mounted to the main body 20 of the image forming apparatus and comprises four pieces of process equipment, i.e., the photosensitive drum 10 functioning as the latent image bearing member, the charging roller 11 functioning as the charging member contacting the photosensitive drum 10, the developing apparatus 13, and the cleaning apparatus 17, integrally supported in the apparatus main body 20.

The process cartridge C is attached to and detached from the main body 20 of the image forming apparatus 20 by opening and closing a cartridge door (main body door) 18 of the main body 20. The mounting of the process cartridge C is performed in such a manner that the process cartridge C is inserted into and mounted to the apparatus main body 20 in a predetermined manner and then the cartridge door 18 is closed. The thus mounted process cartridge C mounted to the apparatus main body 20 in the predetermined manner is in a state mechanically and electrically connected with the main body 20 side of the image forming apparatus.

The removal of the process cartridge C from the apparatus main body 20 is performed by pulling out the process cartridge C within the apparatus main body in a predetermined manner after opening the cartridge door 18. In the removal state of the process cartridge C, a drum cover (not shown) is moved to a closed position to cover and protect an exposed lower surface portion of the photosensitive drum 10. Further, the exposure window is also kept in a closed state by a shutter plate (not shown). The drum cover and the shutter plate are respectively moved to and kept at an open position in the mounting state of the process cartridge C within the apparatus main body 20.

Herein, the process cartridge is prepared by integrally supporting the electrophotographic photosensitive member functioning as the image bearing member and at least one of the charging means, the developing means and the cleaning means, into a single unit, which is detachably mountable to the image forming apparatus main body.

(2) Printer Operation Sequence

A brief explanation of a printer operation sequence in this embodiment will be given with reference to FIG. 2.

Figure 2:
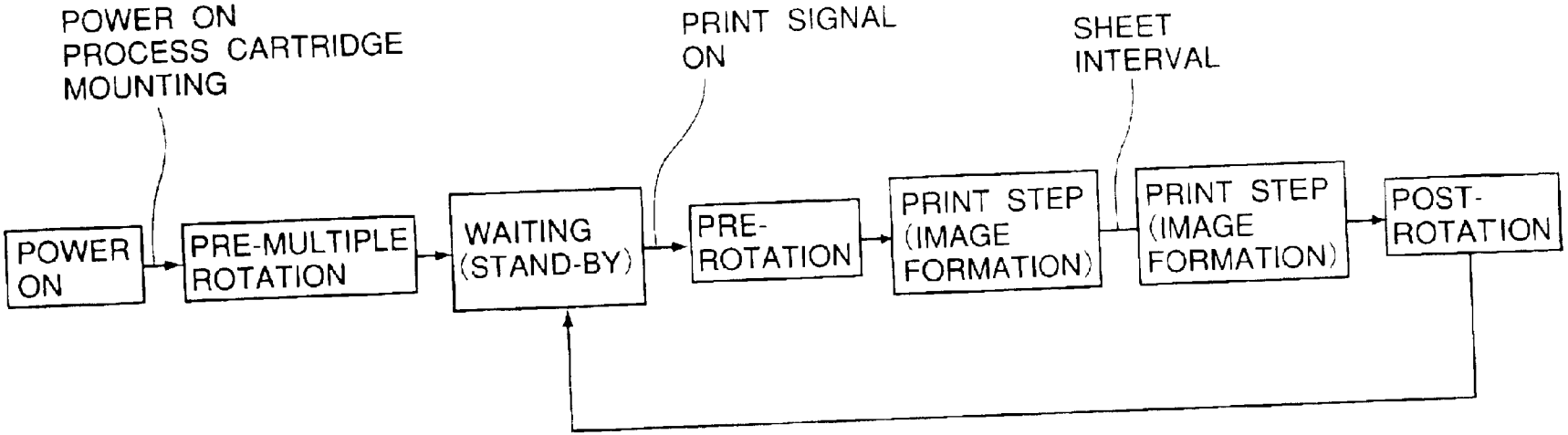
FIG. 2 is a block diagram showing an operating sequence of the image forming apparatus.

Referring to FIG. 2, when the power of the image forming apparatus is turned on, a pre-multiple rotation step starts and during a drive step for rotating the photosensitive drum by a main motor, detection of the presence or absence of the process cartridge and the cleaning of the transfer roller are performed.

After completion of the pre-multiple rotation, the image forming apparatus is placed in a waiting (stand-by) state. When image data is sent from an unshown output means, such as a host computer, to the image forming apparatus, the main motor drives the image forming apparatus, thus placing the apparatus in a pre-rotation step. In the pre-rotation step, preparatory operations for printing by various pieces of process equipment, such as preliminary charging on the photosensitive-drum surface, start-up of a laser-beam scanner, determination of a transfer-print bias and temperature control of the fixing apparatus, are performed.

After the pre-rotation step is completed, the printing step starts. During the printing step, the supply of the transfer material at a predetermined timing, the imagewise exposure on the photosensitive-drum surface, development, etc., are performed. After completion of the printing step, in the case of presence of a subsequent printing signal, the image forming apparatus is placed in a sheet-interval state until a subsequent transfer material is supplied, thus preparing for a subsequent printing operation.

After the printing operation is completed, if a subsequent printing signal is absent, the image forming apparatus is placed in a post-rotation step. In the post-rotation step, charge removal at the photosensitive-drum surface and/or movement of the toner attached to the transfer roller toward the photosensitive drum (cleaning of the transfer roller) are performed.

After completion of the post-rotation step, the image forming apparatus is again placed in the waiting (stand-by) state and waits for a subsequent printing signal.

(3) Generation of Charging Bias and Determination of Appropriate Charging Bias 3-1) Generation of Charging Bias (Charging-Bias Power-Supply Circuit)

The charging-bias power-supply circuit 21 used in this embodiment will be described with reference to FIG. 3. This charging-bias power-supply circuit 21 is not provided to the process cartridge but disposed within the main body of the image forming apparatus.

Figure 3:
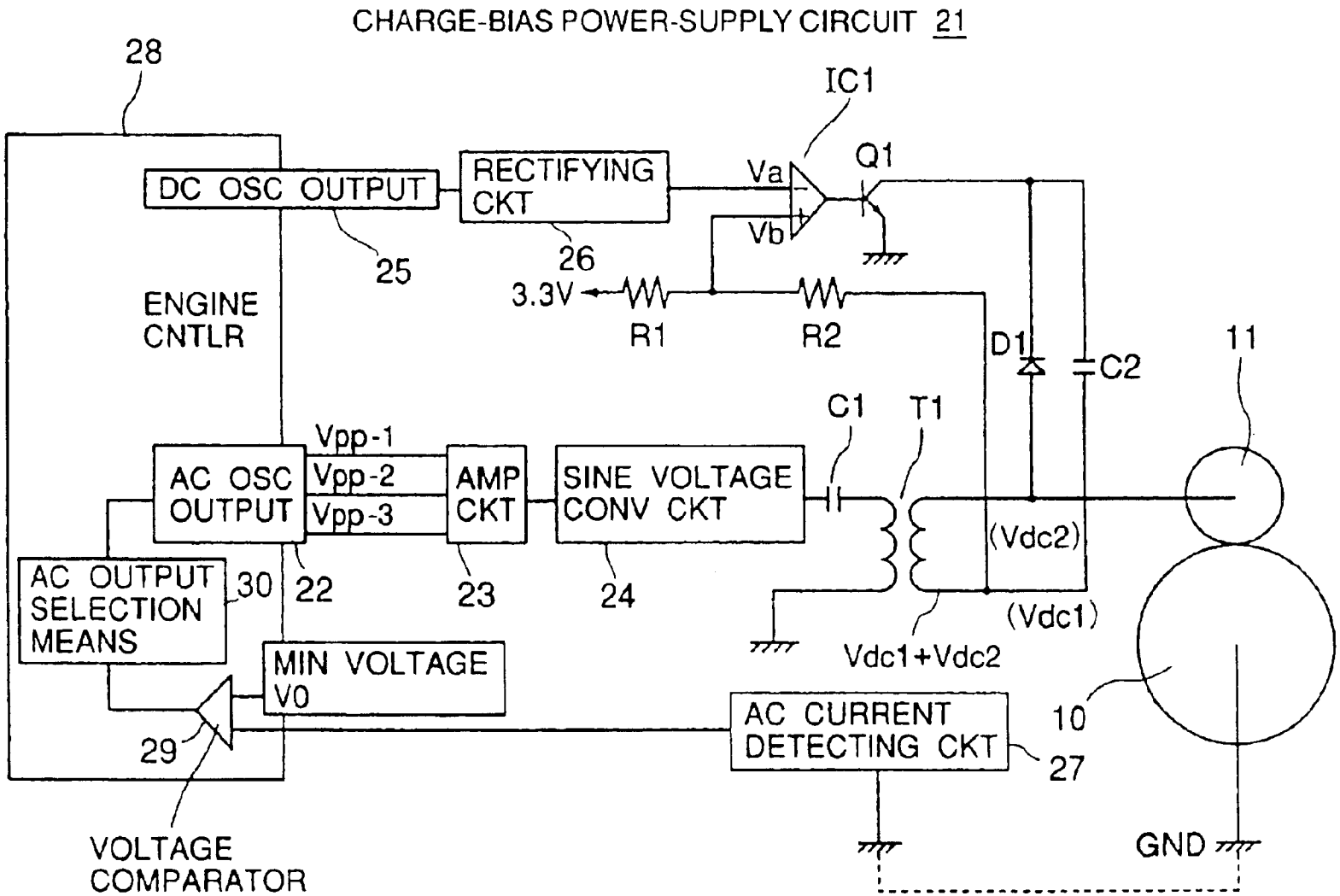
FIG. 3 is a block diagram showing a charging-bias power-supply circuit.

Referring to FIG. 3, the charging-bias power-supply circuit 21 can output three different alternating peak-to-peak voltages Vpp of Vpp-1, Vpp-2 and Vpp-3 (Vpp-1>Vpp-2>Vpp-3) from an AC oscillation output 22. The output of those peak-to-peak voltages Vpp-1, Vpp-2 and Vpp-3 are selectively performed by controlling an AC output-selection means 30 in an engine controller 28.

First, the output voltages outputted from the AC oscillation output 22 are amplified by an amplifying circuit 23, converted into a sinusoidal wave by a sinusoidal voltage-conversion circuit 24 comprising an operation amplifier, a resistor, a capacitor, etc., subjected to removal of the DC component through a capacitor C1, and inputted into a step-up transformer T1 as a voltage-increase means. The voltage inputted into the step-up transformer is boosted into a sinusoidal wave corresponding to the number of turns of the coil of the transformer.

On the other hand, the boosted sinusoidal voltage is rectified by a rectifier circuit D1 and then a capacitor C2 is fully charged, whereby a certain DC voltage Vdc1 is generated. Further, from a DC oscillation circuit 25, an output voltage determined depending on, e.g., the print density, is outputted, rectified by a rectifier circuit 26, and inputted into a negative input terminal of an operation amplifier IC1 as voltage Va. At the same time, into a positive input terminal of the operation amplifier IC1, a voltage Vb produced by dividing one of the terminal voltages of the step-up transformer T1 with two resistors is inputted, and then a transistor Q1 is driven so that the voltages Va and Vb are equal to each other. As a result, a current flows through the resistors R1 and R2 to a cause voltage decrease, thus generating a DC voltage Vdc2.

A desired DC voltage can be obtained by adding the above-described DC voltages Vdc1 and Vdc2, and is superposed with the above-mentioned AC voltage on a second stage side of the AC voltage-increase means T1, so that the resultant voltage is applied to a charging roller 11 within the process cartridge C.

Figure 4:
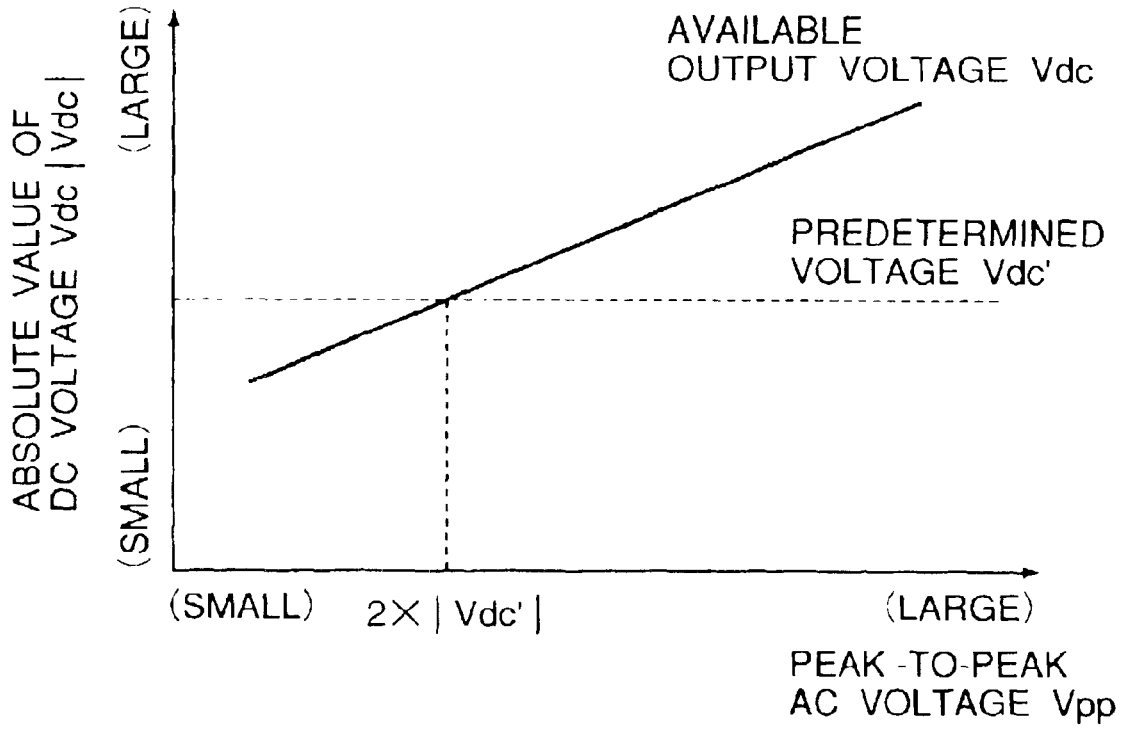
FIG. 4 is a graph showing the relationship between the alternating peak-to-peak voltage and the available output DC voltage.

Incidentally, in this embodiment, the DC voltage is generated by the AC voltage-increase means T1, so that the DC voltage depends upon the peak-to-peak voltage Vpp. In other words, in order to obtain a desired DC voltage Vdc, it is necessary to charge the capacitor C2 with electrical charges at a certain level. As shown in FIG. 4, in order to attain a predetermined DC voltage Vdc', the alternating peak-to-peak voltage Vpp is required to be at least 2×|Vdc'|. If the alternating peak-to-peak voltage Vpp is lower than 2×|Vdc'|, the capacitor C2 cannot be charged fully, thus failing to provide the predetermined DC voltage Vdc'. As a result, the photosensitive-drum surface cannot be charged to have a potential Vd equal to a desired potential level, thus failing to provide a good image.

On the other hand, if a capacitance of the capacitor C2 is increased, the amount of charged electrical charges becomes larger but the time required for charging the capacitor with the electrical charges becomes longer. As a result, the time required to stabilize a charging waveform increases, so that an irregularity in surface potential Vd in the photosensitive-drum surface occurs in some cases.

Accordingly, in this embodiment, a minimum Vpp-min of available alternating peak-to-peak voltages Vpp is set to satisfy the following relationship with a predetermined DC voltage Vdc:

$$Vpp\text{-}min \geqq 2\times|vdc|.$$

3-2) Determination of Appropriate Charging Bias

Figure 5:
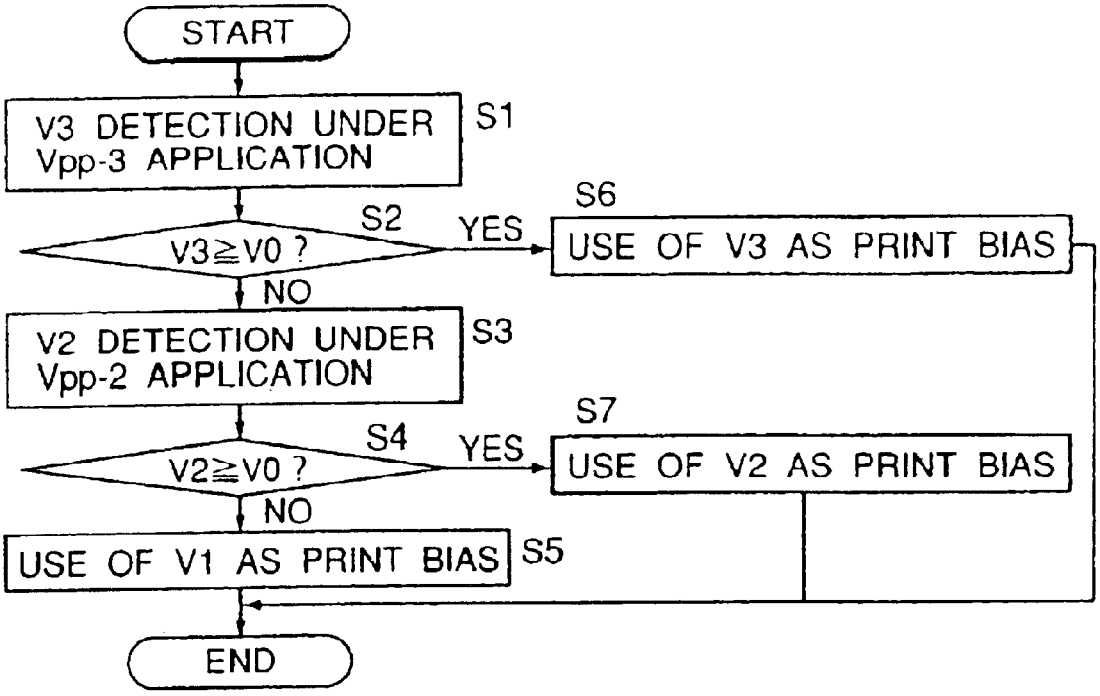
FIG. 5 is a flowchart showing a method of determining the charging bias.

Next, a method of determinating a charging bias at the time of image formation will be explained with reference to FIGS. 3 and 5.

Referring to FIG. 3, when the charging-bias voltage is applied to the charging roller 11, an alternating current Iac flows through a high-voltage power-supply circuit GND via the charging roller 11 and the photosensitive drum 10. At that time, an AC detection means 27 detects and selects only the alternating-current component with a frequency equal to a charging frequency from the alternating current Iac by an unshown filtering circuit, and the selected alternating-current component is converted into a corresponding voltage, which value is then inputted into the engine controller 28. Incidentally, the AC detection means 27 can be constituted by, e.g., a resistor, a capacitor and a diode, thus lessening the increases in cost and space of the power-supply circuit.

The inputted voltage inputted into the engine controller 28 is compared with a minimum voltage V0, which is a predetermined voltage whose input level is preliminarily set by a voltage-comparison means 29. Incidentally, the minimum voltage V0 is an output voltage for the minimum alternating peak-to-peak voltage that does not cause charge irregularity, and a value thereof is determined based on the minimum current value Iac-0 capable of effecting uniform charging. The value of Iac-0 is set on the basis of the process speed of the apparatus, the charging frequency, and the materials for the charging apparatus 11 and photosensitive drum 10. For this reason, it is preferable that the minimum voltage 0 is also appropriately set in each case.

The engine controller 28 includes an AC output-selection means 30 which selects a minimum AC output voltage, which is at least the minimum voltage V0, i.e., selects a charging bias at the time of image formation, specifically with respect to an area corresponding to an image forming area (second area) of the photosensitive drum.

Next, the procedure from the AC current detection to the charging-bias determination in this embodiment will be described with reference to a flowchart of FIG. 5. In this embodiment, the charging-bias power-supply circuit 21 employing three output voltages Vpp-1, Vpp-2 and Vpp-3 (satisfying Vpp-1>Vpp-2>Vpp-3), which are outputted from the AC oscillation output 22, is used.

First, when the lowest peak-to-peak voltage Vpp-3 of the different alternating peak-to-peak voltages is applied, the AC current detection means 27 detects and converts an alternating current Iac-3 passing through the photosensitive drum into a detection voltage V3, which is fed back to the engine controller 28 (Step S1). At this time, if V3≧V0, V3 is determined as a charging bias at the time of printing (referred to as "print(ing) bias") (Steps S2 and S6).

On the other hand, if V3<V0, the intermediate voltage Vpp-2 is applied and a resultant detection voltage V2 is fed back and compared with V0 (Steps S2, S3 and S4). If V2≧V0, V2 is used as the print bias (Steps S4 and S7). If V2<V0, Vpp-1 is used as the print bias (Steps S4 and S5).

In this case, an output voltage V1 at the time of applying the maximum voltage Vpp-1 of the available peak-to-peak voltages is preliminarily set to satisfy V1≧V0 in any environment, whereby charge failure cannot occur in any environment.

The above-mentioned steps may be performed in the pre-multiple rotation process from immediately after the power is turned on to the stand-by state of the apparatus, and more preferably may be performed at least one time at an arbitrary timing except for the printing process after the printing operation starts, i.e., at any time during a non-image formation operation. In other words, in order to determine the peak-to-peak voltage, it becomes possible to apply different peak-to-peak voltages to the charging roller in ascending order at least to a part of an area corresponding to the non-image forming area (first area). Further, the order of bias application is not necessarily identical to that shown in FIG. 5. According to the above bias-determination procedure, the alternating current Iac passing through the photosensitive drum can be detected substantially successively, thus allowing better charge-bias control.

(4) Effects

Hereinbelow, effects of this embodiment will be described.

a) Effect on Cost Reduction and Space Saving of Power-Supply Circuit

Figure 6:
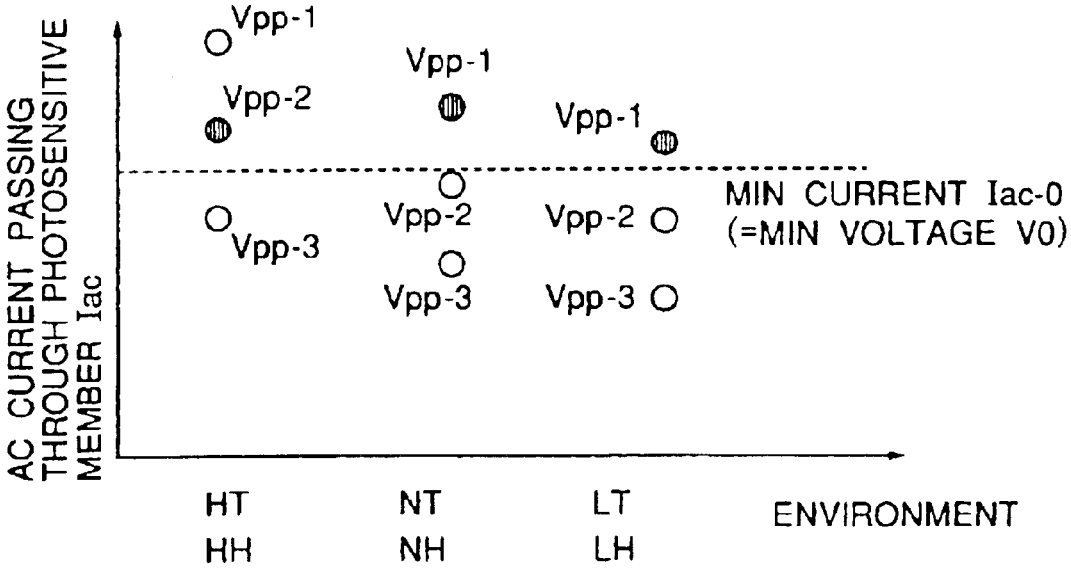
FIGS. 6, 7, 8A and 8B are graphs each for explaining an effect of Embodiment 1.

As described above, in this embodiment, the superposed voltage of AC and DC is applied by the single voltage-increase means for AC output, so that it becomes possible to realize space saving and cost reduction of the power-supply circuit. Further, the minimum voltage Vpp-min of the available peak-to-peak voltages and a desired DC voltage Vdc are set to satisfy the relationship: $Vpp\text{-}min \geqq |vdc| \times 2$, so that it is possible to stably obtain a desired charging-bias voltage even when the DC/AC superposed voltage is outputted from the single voltage-increase means.

b) Effect on Charge Control b-1) Effect on Fluctuations in Operation Environments FIG. 6 is a graph showing the relationship between operation environments and the detection current Iac by the AC current-detection means 27 when charging voltages Vpp-1, Vpp-2 and Vpp-3 are applied by using the same image forming apparatus in a low-temperature (LT) and low-humidity (LH) environment (10° C., 10% RH), a normal-temperature (NT) and normal humidity (NH) environment (23° C., 64% RH), and a high-temperature (HT) and high-humidity environment (HH) (35° C., 85% RH), respectively.

The charging apparatus has an impedance which is large in the LT/LH environment and is small in the HT/HH environment, thus resulting in a change in the alternating current Iac.

As shown by dark (black) circles in FIG. 6, the minimum peak-to-peak voltage for providing at least the minimum current Iac-0 (detection voltage V0) is Vpp-1 in the LT/LH and NT/NH environments and Vpp-2 in the HT/HH environment, so that these peak-to-peak voltages are selected in the respective environments.

As a result, even in the case where the impedance of the charging apparatus is changed depending on a change in environment, an excessive alternating current does not pass through the photosensitive drum, so that it is possible to effect better charge control.

b-2) Effect on Change of Operating Time (The Number of Printing Sheets)

Figure 7:
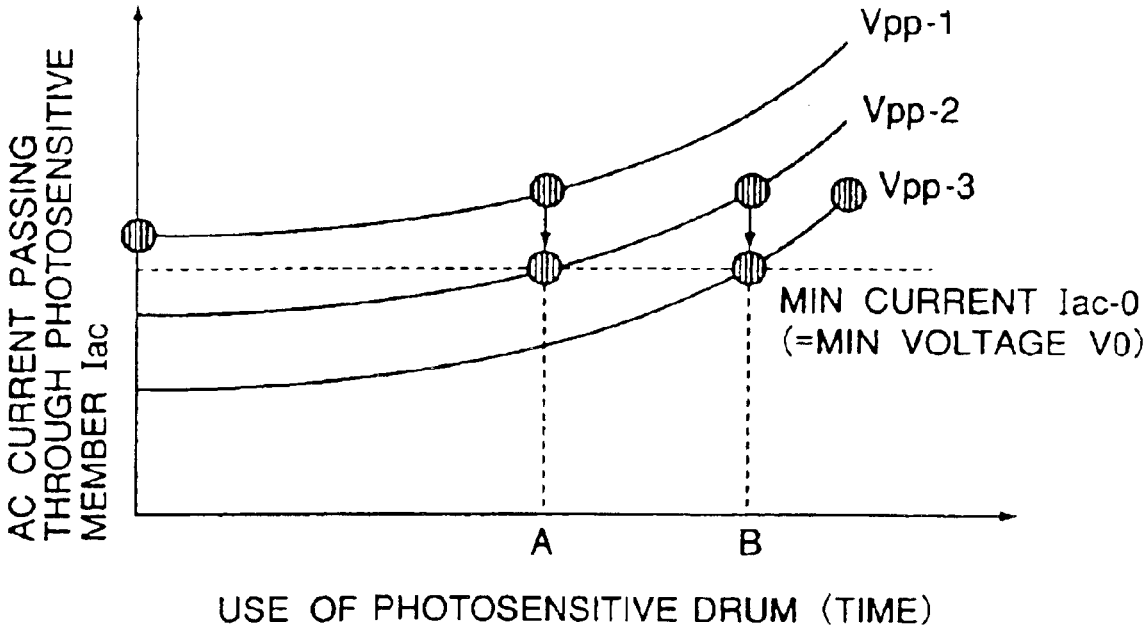

As shown in FIG. 7, the AC value Iac is increased with an increasing number of printing sheets by the photosensitive drum 10. This is attributable to a lowering in impedance by abrasion (wearing) of the photosensitive-drum surface.

Referring to FIG. 7, e.g., in the LT/LH environment, Vpp-1 is used as the printing bias at an initial stage. At time A of the use of photosensitive drum, an AC value under application of Vpp-1 exceeds the minimum-current value Iac-0, so that Vpp-2 is used as the printing bias at the time of image formation from the time A forward. Further, at time B, an AC value under application of Vpp-2 exceeds the Iac-0, so that Vpp-3 is used as the printing bias from the time B forward.

Also in the HT/HH environment, a similar control is performed. As a result, an increase in alternating current is effectively suppressed to allow good charging over the entire use of the photosensitive drum.

b-3) Effect on Output Tolerance of AC Peak-to-Peak Voltage

Figure 8A:
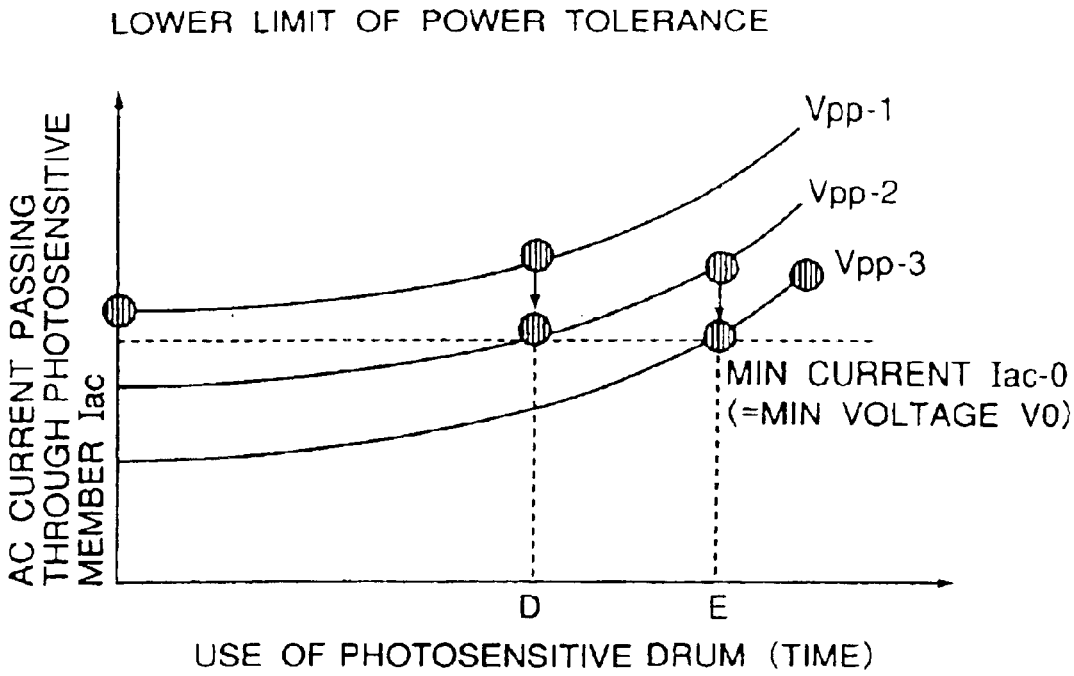
Figure 8B:
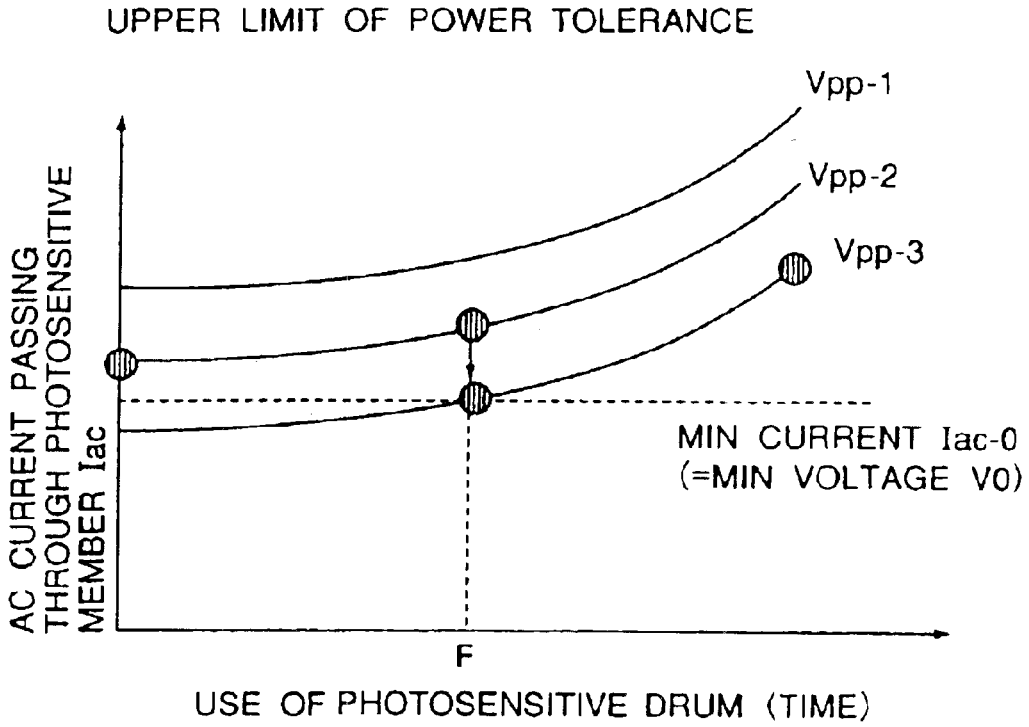

FIGS. 8A and 8B are graphs showing the relationship between the operating time of photosensitive drum and an AC value Iac in the case of lower and upper limits of power tolerances, respectively.

In the case of the upper limit of power tolerance (FIG. 8B), the outputted peak-to-peak voltage values are generally increased. Accordingly, Vpp-2 is used as a printing bias at an initial stage and is switched to Vpp-3 on and after an operation time F of the photosensitive drum. On the other hand, in the case of the lower limit of power tolerance (FIG. 8A), Vpp-1 is used as a printing bias at an initial stage, is switched to Vpp-2 at an operation time D, and is switched to Vpp-3 at an operation time F. As a result, even in the case where the tolerance of the charging-bias power supply is taken into consideration, it is possible to effect charge control by suppressing the increase in the AC value.

As described above, although the effects of this embodiment are described while taking the method of controlling the three species of peak-to-peak voltages as an example, the effects are similarly achieved by the use of other charge-bias power-supply circuits capable of outputting two or more species of AC peak-to-peak voltages. Accordingly, it should be understood that such cases are also embraced by the scope of the present invention.

As described above, according to this embodiment, even in the system for applying a superposed bias of AC and DC by the single voltage-increase means, the AC current-detection means detects a current value passing through the photosensitive member (drum) under the application of a plurality of AC voltages during the pre-rotation operation or at an arbitrary timing during which there is no image formation, and a suitable voltage level is employed as a bias voltage. Consequently, the alternating current Iac passing through the photosensitive member is substantially adjusted to be close to a certain value.

As a result, it becomes possible to perform charge control by which the impedance change due to the operation environments and the film thickness of the photosensitive drum, and the tolerance of the charging-bias power supply are corrected. As a result, it becomes possible to realize a cost reduction and space saving of the power-supply circuit and the process cartridge in combination with the discharge control.

<Embodiment 2>

When an alternating peak-to-peak voltage Vpp is controlled to be constant, the photosensitive-drum surface is gradually abraded with the use thereof to increase a current Iac passing through the photosensitive drum. As a result, the AC voltage is, as shown in, e.g., FIG. 7, applied in such a manner that Vpp-1 is applied from the initial stage before the operation time A and is switched to Vpp-2 lower than Vpp-1 from the operation time A. In other words, a printing bias Vpp-n is inevitably changed to a voltage value Vpp-(n+1) which is lower than Vpp-n by one level at a certain stage.

In this embodiment, by utilizing such a characteristic, the procedure from the detection of current passing through the photosensitive drum to the deterioration of printing bias at the time of image formation is simplified. More specifically, in this embodiment, the printing bias Vpp-n at the time of image formation is determined by effecting the AC detection described in Embodiment 1 when the power is turned on, and in printing operation, the voltage value Vpp-(n+1) is lower than the printing bias Vpp-n by one level at all or a part of the time of the non-image formation operation. In the case where a resultant voltage value Vn+1 detected at that time exceeds the minimum voltage value V0, the subsequent printing bias is lowered by one level.

The charging-bias-determination procedure in this embodiment will be described based on flowcharts shown in FIGS. 9A and 9B.

Figure 9A:
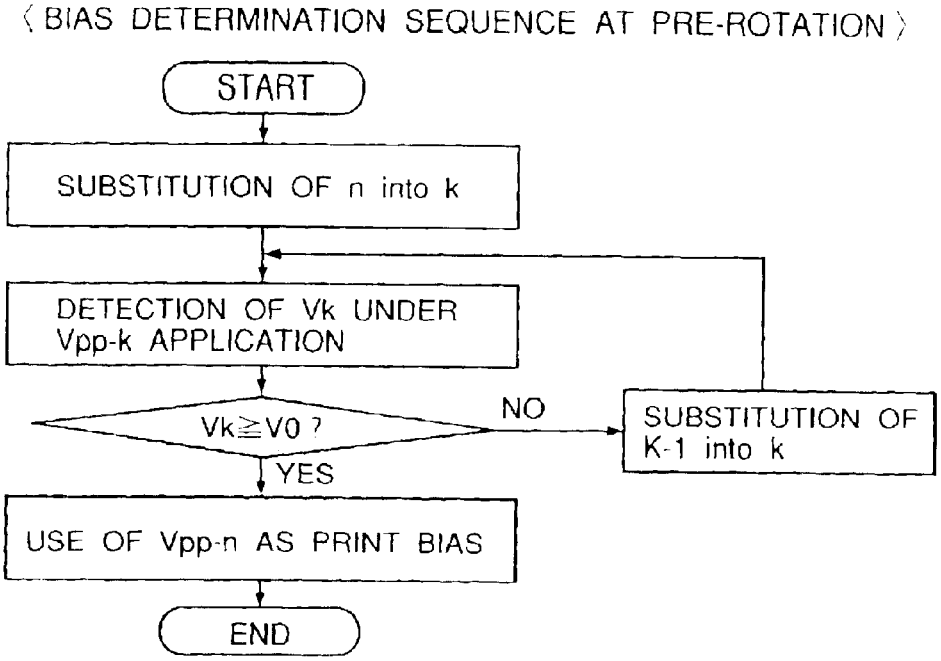
FIGS. 9A and 9B are flowcharts showing methods of determining a charging bias in Embodiment 2.
Figure 9B:
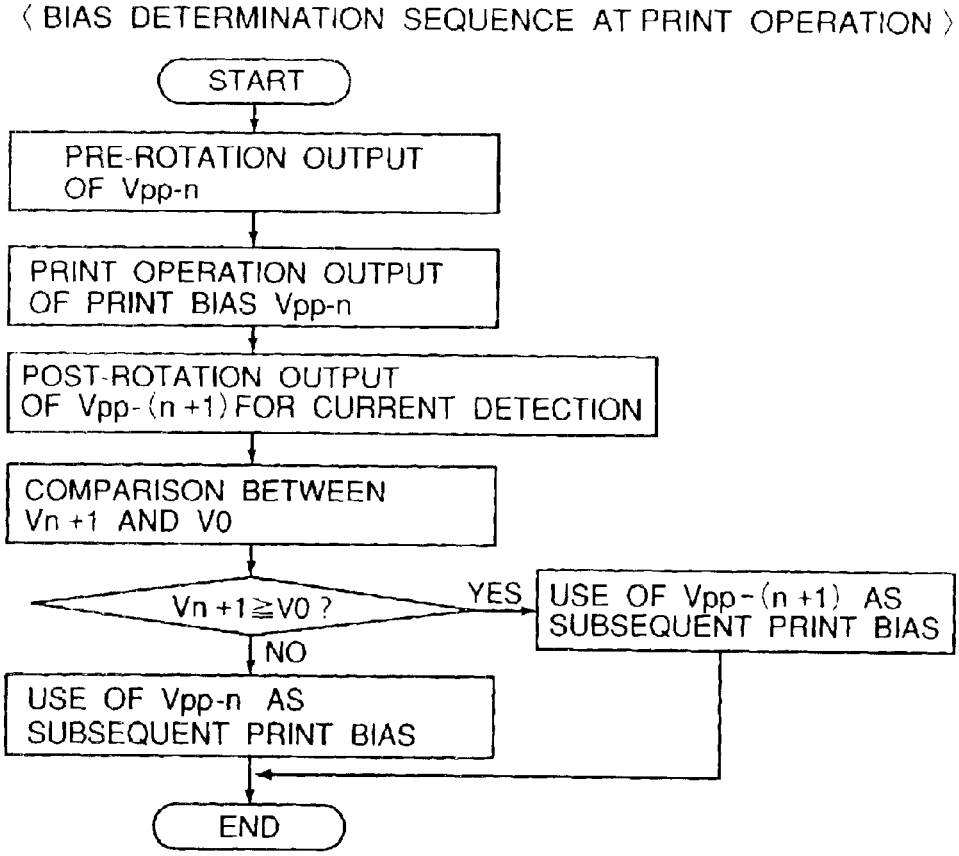

First, when the process cartridge is mounted, as shown in FIG. 9*a*, a printing bias Vpp-n at the time of image formation i.e., when the charging position of the charging member is in an area (second area) corresponding to the image-forming area of the photosensitive drum, is determined in the same manner as in Embodiment 1.

During the printing operation, the voltage value Vpp-(n+1), which is lower than Vpp-n by one level, is applied in all or a part of the period of non-image formation. More specifically, all or a part of the time when the charging position is in an area (first area) corresponding to the non-image forming area, the voltage value Vpp-(n+1) is applied. FIG. 9B shows a sequence wherein Vpp-(n+1) is applied in the post-rotation process as an example in this embodiment. Referring to FIG. 9B, if a detected voltage Vn+1 at that time is below the minimum voltage V0, Vpp-n is successively used as a printing bias for a subsequent image-formation operation. If Vn+1 is at least the minimum voltage V0, Vpp-(n+1) is used as the printing bias for the subsequent image-formation operation. Incidentally, although the example of applying Vpp-(n+1) in the post-rotation process is shown, Vpp-(n+1) may be applied at any timing, e.g., in the pre-rotation process.

By using the above-mentioned procedure, the bias voltage required to be applied in the current-detection sequence at the time of a printing operation becomes only one voltage value (Vpp-(n+1)), thus reducing the time from the AC detection to the bias determination. As a result, it is possible to apply the procedure to an image forming apparatus having a shorter image-forming time.

Further, at all or a part of the time of non-image formation, a bias lower than the printing bias is applied, thereby lowering the amount of discharged electrical charges. As a result, the effect of decreasing the degree of abrasion of the photosensitive drum is also achieved.

<Embodiment 3>

As shown in FIG. 6, the AC value Iac passing through the photosensitive drum at the time of applying the same charging voltage Vpp varies depending on the operating environments even at the initial stage. This may be principally attributable to a fluctuation in electrical resistance of the charging apparatus in such a manner that the change in electrical resistance becomes larger in the LT/LH environment and smaller in the HT/HH particularly under the influence of humidity.

This embodiment is characterized in that the ratio of the electrical resistance R-low in the LT/LH environment (101C/10% RH) to the electrical resistance R-high in the HT/HH environment (35° C./85% RH), of the charging apparatus used is in the range of $0.1 \leqq$ R-low/R-high $\leqq$ 10. The electrical resistance referred to herein is measured in the following manner.

(1) Method of Measuring the Resistance

Figure 10:
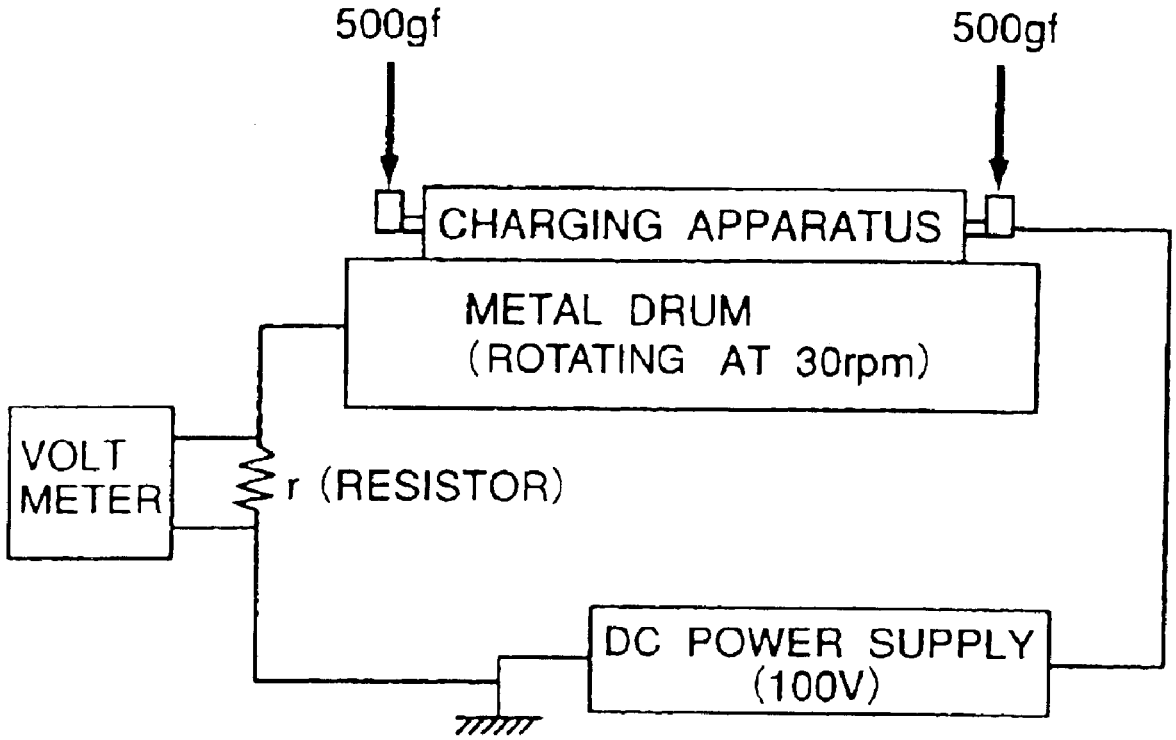
FIG. 10 is a view showing a method of measuring the electrical resistance mentioned in Embodiment 3.

FIG. 10 is a view for explaining the method of measuring the resistance of the charging apparatus.

Referring to FIG. 10, the charging apparatus is pressed against a metal drum having a diameter of 30 mm under a load of 500 gf at both ends thereof. The metal drum is rotated at a speed of 30 rpm by a metal drum-drive means (not shown). During the rotation of the metal drum, a voltage of 100 V is applied to a core metal of the charging apparatus. After a lapse of 10 sec from the voltage application, a voltage value E(V) exerted on a fixed resistor r (r=1–100 kΩ) is read by a volt meter.

The resistance R of the charging apparatus is calculated according to the following equation:

$$R(\Omega)=100/(E/r)$$

Further, the resistance of the charging apparatus in the LT/LH environment refers to a measured value of the resistance of the charging apparatus after the charging apparatus is left standing for 8 hours in an environment of 10° C. and 10% RH and the resistance of the charging apparatus in the HT/HH environment refers to a measured value of the resistance of the charging apparatus after the charging apparatus is left standing for 8 hours in an environment of 35° C. and 85 RH.

(2) Effects of this Embodiment

Figure 11A:
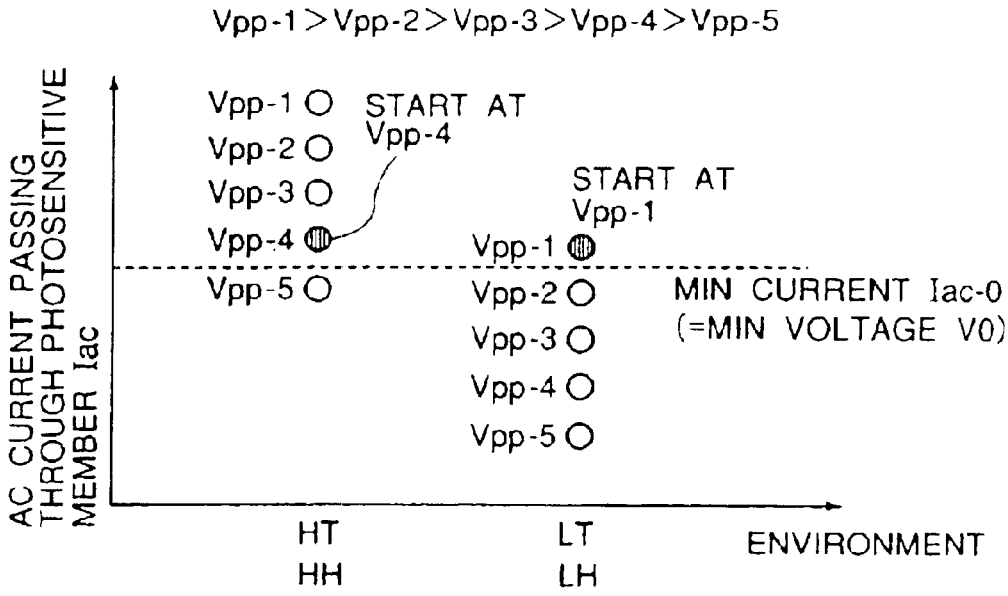
FIGS. 11A and 11B are graphs for explaining an effect of Embodiment 3 in the case of a larger resistance variation.
Figure 11B:
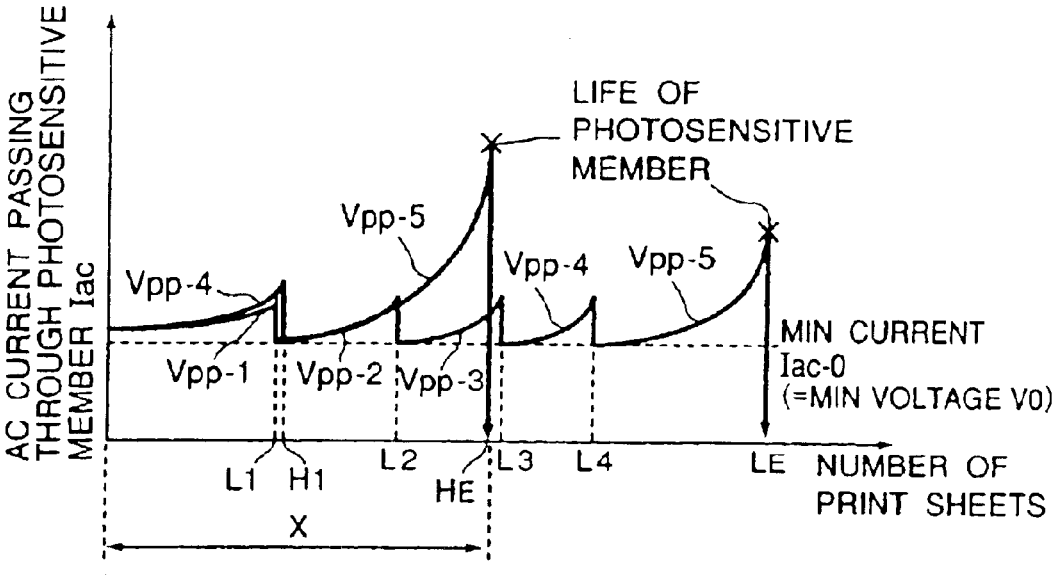

FIG. 11A schematically shows an environmental change in AC passing through the photosensitive drum at an initial stage in an image forming apparatus including a charging-bias power supply having 5 switchable voltage levels and a charging apparatus causing a large environmental change in resistance, and FIG. 11B shows a current value progression in the case of performing a continuous image formation operation by the image forming apparatus.

Referring to FIG. 11A, as a charging-voltage value Vpp in the LT/LH environment, Vpp-1, which provides a current value larger than a predetermined minimum current value Iac-0, is selected. On the other hand, in the HT/HH environment, Vpp-4, which provides a current value larger than Iac-0 and is lowest among the peak-to-peak voltages providing current values exceeding Iac-0, is selected as Vpp.

In these environments, when the image formation operation is continued, as shown in FIG. 11B, the charging-voltage value Vpp is changed from Vpp-1 to Vpp-2 at the time when the number of print sheets reaches L1 in the LT/LH environment. Thereafter, Vpp is changed at times when the number of printed sheets reaches L2 , L3 and L4 , and the photosensitive-drum life expires at LE.

On the other hand, in the HT/HH environment, at time when the number of printed sheets reaches H1 , Vpp is changed from Vpp-4 to Vpp-5 and the photosensitive-drum life expires at HE at an earlier stage than that in the LT/LH environment since there is no voltage value smaller than Vpp-5. As a result, the photosensitive life X capable of being guaranteed to users is shortened. In order to prolong the photosensitive-drum life in the HT/HH environment, it is possible to use means for adding applied voltages (Vpp-6, Vpp-7, . . . ) lower than Vpp-5 to the charging-bias power-supply circuit but in view of the desirability of achieving a cost reduction and space saving in the power-supply circuit, it is preferable that such a modification is not made.

Figure 12A:
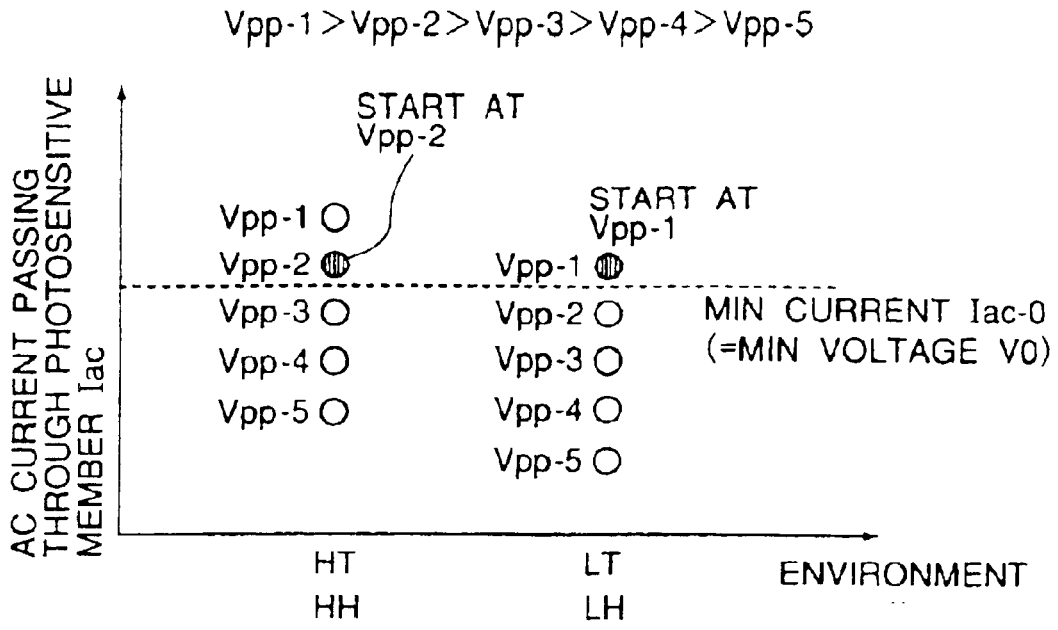
FIGS. 12A and 12B are graphs for explaining an effect of Embodiment 3 in the case of a smaller resistance variation.
Figure 12B:
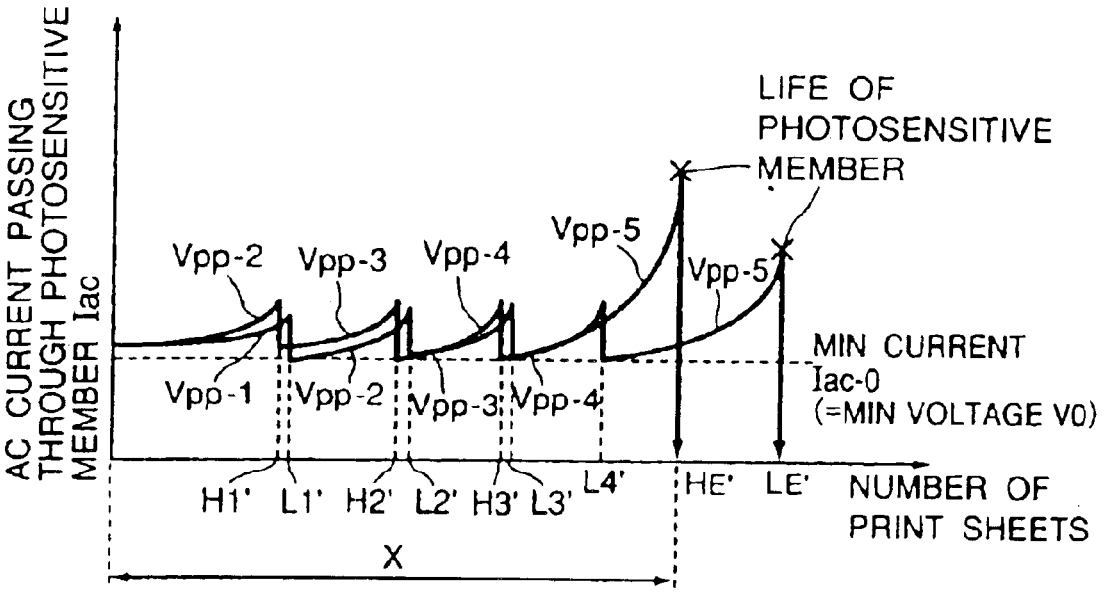
Figure 13:
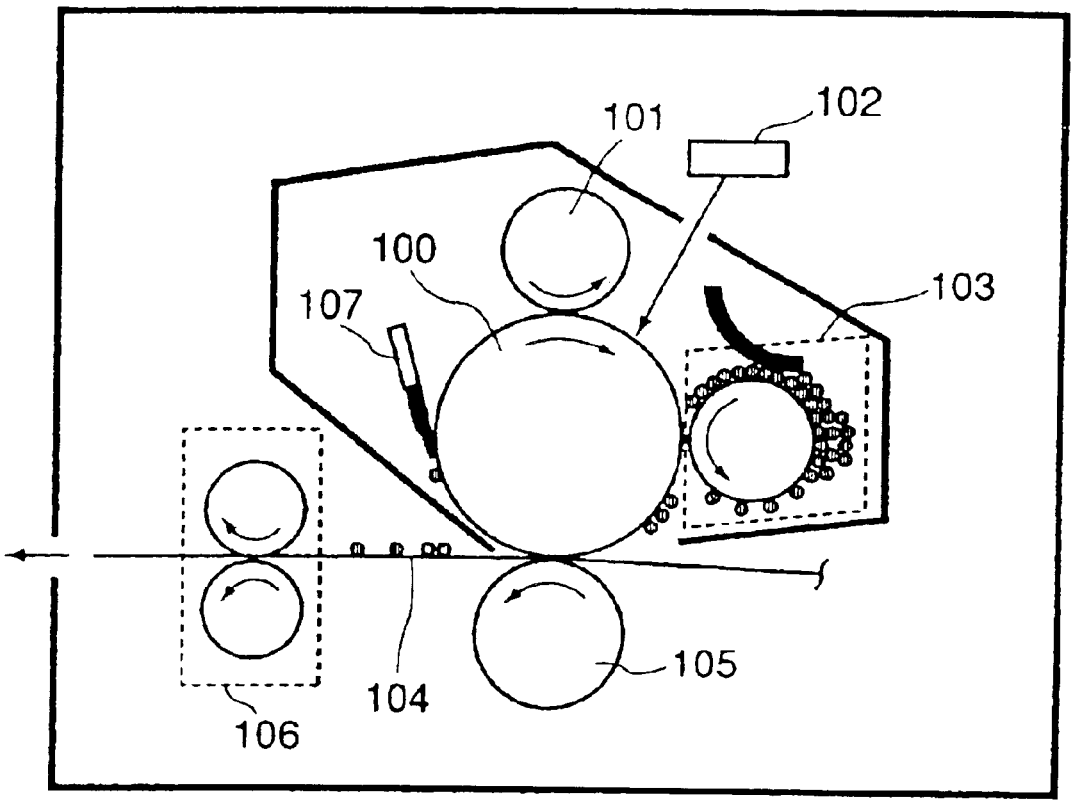
FIG. 13 PRIOR ART
FIG. 13 is a schematic sectional view showing a conventional image forming apparatus.
Figure 14A:
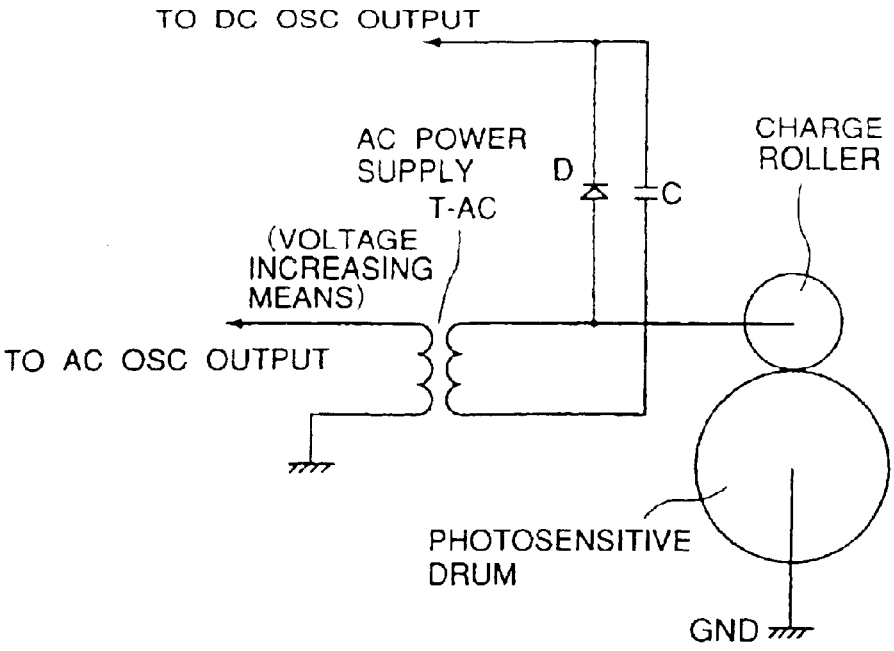
FIG. 14A PRIOR ART
FIGS. 14A and 14B are diagrams showing conventional charging-bias power-supply circuits.
Figure 14B:
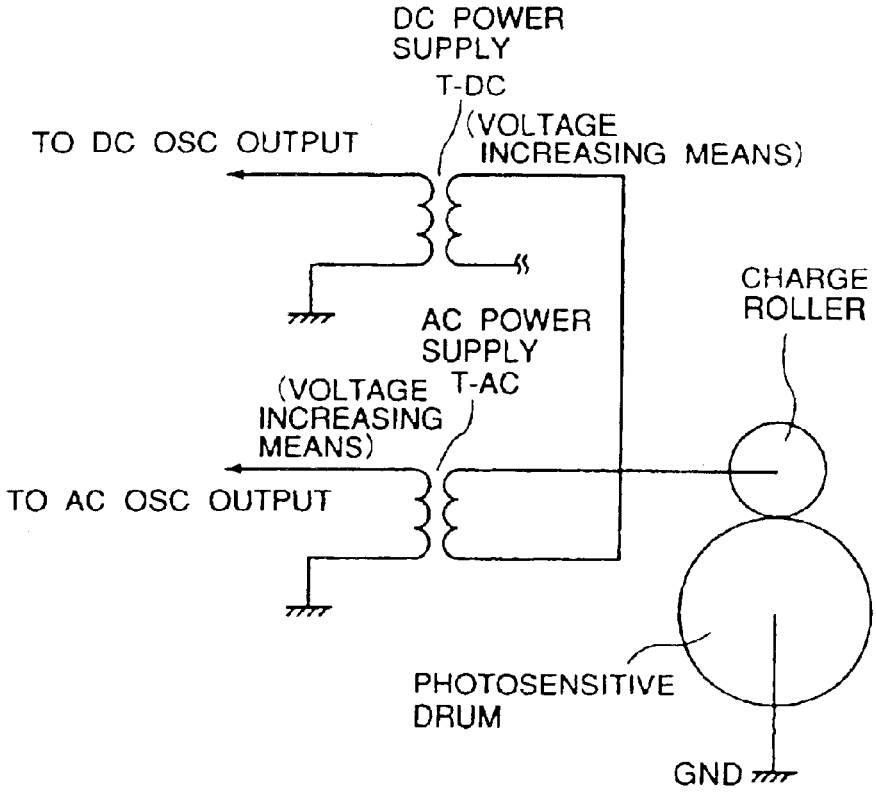
FIG. 14B PRIOR ART

Next, FIG. 12A schematically shows an environmental change in AC passing through the photosensitive drum at an initial stage in an image forming apparatus including a charging-bias power supply having 5 switchable voltage levels and a charging apparatus causing a relatively small environmental change in resistance, and FIG. 12B shows a current value progression in the case of performing a continuous image-formation operation.

Referring to FIG. 12A, as a charging-voltage value Vpp in the LT/LH environment, Vpp-l, which provides a current value larger than the minimum-current value Iac-0 and is the lowest peak-to-peak voltage value, is selected. On the other hand, in the HT/HH environment, Vpp-2, which provides a current value larger than Iac-0 and is the lowest peak-to-peak voltage value, is selected as Vpp.

When the continuous image-formation operation is performed in these environments, as shown in FIG. 12B, Vpp is changed from Vpp-1 to Vpp-2 at the time L1' (when printing on a predetermined number of sheets is completed), followed by successive changes to L2', L3' and L4' to finally reach LE' corresponding to the photosensitive-drum life.

On the other hand, in the HT/HH environment, Vpp is changed from Vpp-2 to Vpp-3 at the time H1', followed by successive change to H2' and H3' to finally reach HE' corresponding to the photosensitive-drum life. If the charging apparatus suffers a smaller change in environmental condition, the current value progression during the continuous image-formation operation in the HT/HH environment can be brought closer to that under constant-current control. As a result, the life the photosensitive drum in the HT/HH environment can be prolonged to allow a longer photosensitive-drum life to be guaranteed to users.

As described above, the environmental change in resistance of the charging apparatus may preferably be as small as possible. According to our study, it has been confirmed that if the ratio of R-low (resistance at 11° C. and 10% RH after standing for 8 hours) to R-high (resistance at 35° C. and 85% RH after standing for 8 hours) satisfies the relationship of: $0.1 \leqq \text{R-low/R-high} \leqq 10$, it is possible to control the charging level with no practical problem. Further, it has also confirmed that it is also possible to effect better charge control if $0.5 \leqq \text{R-low/R-high} \leqq 2$ is satisfied.

<Embodiment 4>

Then, another embodiment of a sequence of printing operation will be shown.

This embodiment is characterized in that an image forming apparatus includes at least a charging-bias-generation circuit having an alternating oscillation output capable of outputting a superposed voltage of AC and DC by a single voltage-increase means and at least two species of alternating peak-to-peak voltages, and also includes an AC current-detection means for detecting an alternating current passing through a photosensitive member (drum) at the time of charging-bias application, wherein the AC current-detection means detects an alternating current Iac passing through the photosensitive drum under application at least two species of alternating peak-to-peak voltages at the time of pre-multiple rotation after the process cartridge is mounted and feeds back the detected alternating currents Iac into an engine controller to select a voltage level in an area causing no charge failure as a charging-bias voltage at the time of printing, and the selected charging-bias voltage is applied at the time of image formation.

The image forming apparatus used in this embodiment has a configuration identical to that of the apparatus used in Embodiment 1.

In this embodiment, the single image forming apparatus main body is capable of applying appropriate bias voltages to each of two species of process cartridges different in the film thickness of their photosensitive drums.

(2) Printer Operation Sequence

A brief explanation of a printer-operation sequence in this embodiment will be given with reference to FIG. 15.

Figure 15:
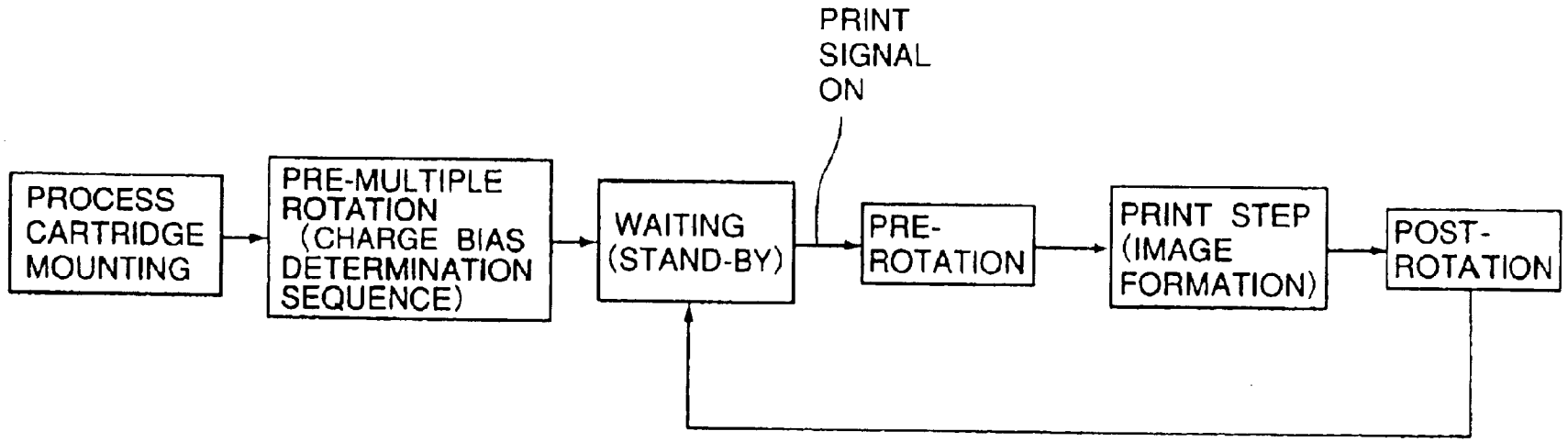
FIG. 15 is a block diagram showing an operating sequence of an image forming apparatus.

Referring to FIG. 15, when the power of the image forming apparatus is turned on in a state such that a detachably mountable process cartridge C is mounted to a main body 20 of the image forming apparatus and a cartridge door is closed, a pre-multiple rotation step starts and during a drive operation for rotation of the photosensitive drum by a main motor, detection of the presence or absence of the process cartridge and the cleaning of the transfer roller are performed. This embodiment is characterized in that a charging-bias-determination sequence is introduced in this step as described hereinafter.

After completion of the pre-multiple rotation, the image forming apparatus is placed in a waiting (stand-by) state. When image data is sent from an unshown output means, such as a host computer, to the image forming apparatus, the main motor drives the image forming apparatus, thus placing the apparatus in a pre-rotation step. In the pre-rotation step, preparatory operations for printing by various pieces of process equipment, such as preliminary charging on the photosensitive-drum surface, start-up of a laser-beam scanner, determination of a transfer-print bias and temperature control of the fixing apparatus, are performed.

After the pre-rotation step is completed, the printing step starts. During the printing step, the supply of the transfer material at a predetermined timing, imagewise exposure on the photosensitive-drum surface, development, etc., are performed. After completion of the printing step, in the case the of presence of a subsequent printing signal, the image forming apparatus is placed in a sheet-interval state until a subsequent transfer material is supplied, thus preparing for a subsequent printing operation.

After the printing operation is completed, if a subsequent printing signal is absent, the image forming apparatus performs a post-rotation step. In the post-rotation step, charge removal at the photosensitive-drum surface and/or movement of the toner attached to the transfer roller toward the photosensitive drum (cleaning of the transfer roller) are performed.

After completion of the post-rotation step, the image forming apparatus is again placed in the waiting (stand-by) state and waits for a subsequent printing signal.

(3) Generation of Charging Bias and Determination of Appropriate Charging Bias 3-1) Generation of Charging Bias (Charging Bias Power Supply Circuit)

The charging-bias power-supply circuit 21 used in this embodiment will be described with reference to FIG. 16.

Figure 16:
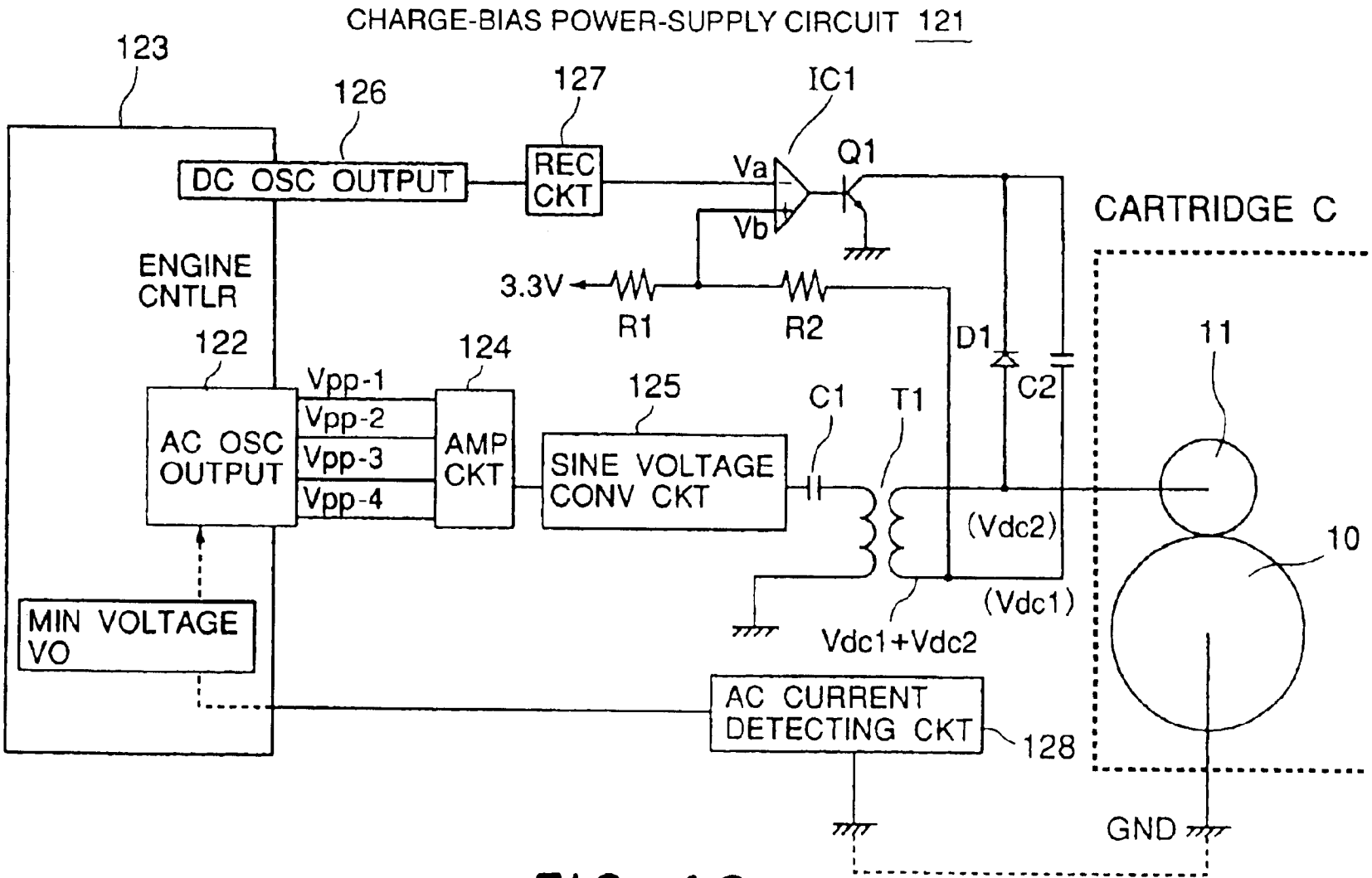
FIG. 16 is a block diagram showing a charging-bias power-supply circuit.

Referring to FIG. 16, the charging-bias power-supply circuit 121 can output different four alternating peak-to-peak voltages Vpp of Vpp-1, Vpp-2, Vpp-3 and Vpp-4 (Vpp-1>Vpp-2>Vpp-3>Vpp-4) from an AC oscillation output 122. The output of those peak-to-peak voltages Vpp-1, Vpp-2, Vpp-3 and Vpp-4 are selectively controlled by an engine controller 123.

First, the output voltages outputted from the AC oscillation output 122 are amplified by an amplifying circuit 124, converted into a sinusoidal wave by a sinusoidal voltage-conversion circuit 125 comprising an operation amplifier, a resistor, a capacitor, etc., subjected to removal of the DC component through a capacitor C1, and inputted into a step-up transformer T1 functioning as a voltage-increase means. The voltage inputted into the step-up transformer is boosted into a sinusoidal wave corresponding to the number of turns of the coil of the transformer.

On the other hand, the boosted sinusoidal voltage is rectified by a rectifier circuit D1 and then a capacitor C2 is fully charged, whereby a certain DC voltage Vdc1 is generated. Further, from a DC oscillation circuit 126, an output voltage determined depending on, e.g., the print density, is outputted, rectified by a rectifier circuit 127, and inputted into a negative input terminal as voltage Va of an operation amplifier IC1. At the same time, into a positive input terminal of the operation amplifier IC1, a voltage Vb, produced by dividing one of the terminal voltages of the step-up transformer T1 with two resistors, is inputted, and then a transistor Q1 is driven so that the voltages Va and Vb are equal to each other. As a result, a current flows through the resistors R1 and R2 to cause a voltage decrease, thus generating a DC voltage Vdc2.

A desired DC voltage can be obtained by adding the above-described DC voltages Vdc1 and Vdc2, and is superposed with the above-mentioned AC voltage on a second-stage side of the AC voltage-increase means T1, so that the resultant voltage is applied to a charging roller 11 within the process cartridge C.

Figure 17:
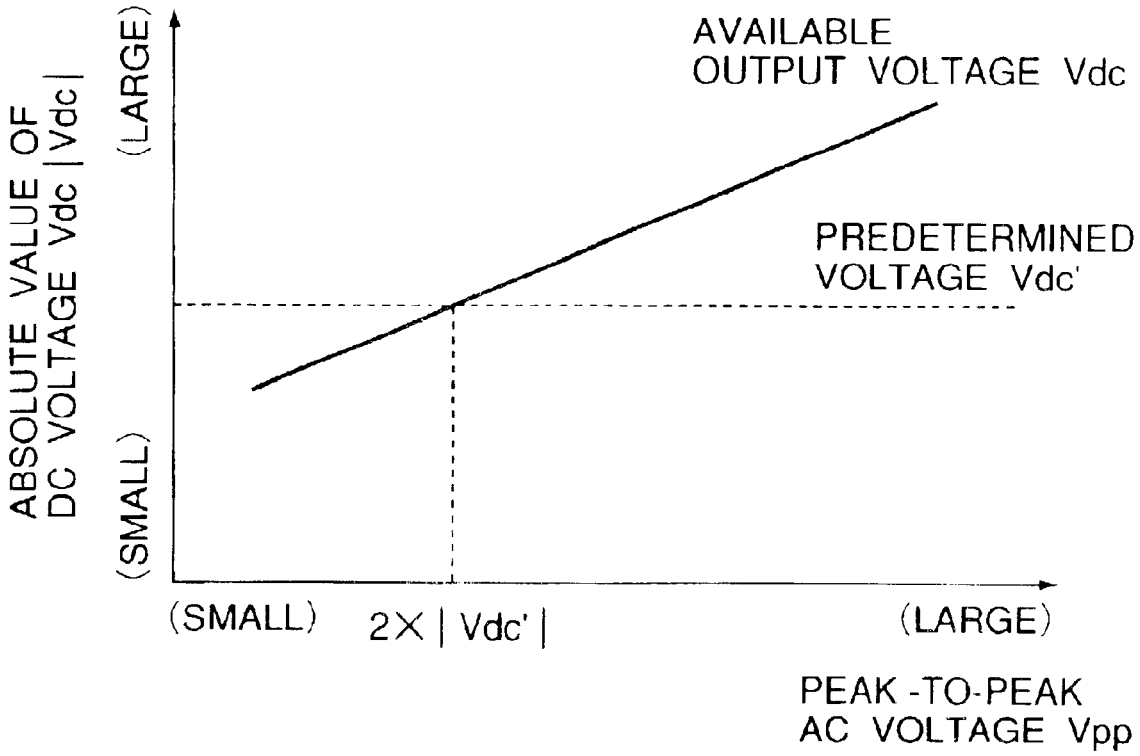
FIG. 17 is a graph showing the relationship between an alternating peak-to-peak voltage and an available output DC voltage.

Incidentally, in this embodiment, the DC voltage is generated by the AC voltage-increase means T1, so that the DC voltage depends upon the peak-to-peak voltage Vpp. In other words, in order to obtain a desired DC voltage Vdc, it is necessary to charge the capacitor C2 with electrical charges at a certain level. As shown in FIG. 17, in order to attain a predetermined DC voltage Vdc', the alternating peak-to-peak voltage Vpp is required to be at least $2\times|vdc'|$. If the alternating peak-to-peak voltage Vpp is lower than $2\times|vdc'|$, the capacitor C2 cannot be charged fully, thus failing to provide the predetermined DC voltage Vdc'. As a result, the photosensitive-drum surface cannot be charged to have a potential Vd equal to a desired potential level, thus failing to provide a good image.

On the other hand, if the capacitance of the capacitor C2 is increased, the amount of stored electrical charges becomes larger, but the time required to charge the capacitor with electrical charges becomes longer. As a result, the time required to stabilize a charging waveform increases, so that the an irregularity in surface potential Vd of the photosensitive-drum surface occurs in some cases.

Accordingly, in this embodiment, a minimum Vpp-min of available alternating peak-to-peak voltage Vpp is set to satisfy the following relationship with a predetermined DC voltage Vdc:

$$Vpp\text{-}min \geqq 2\times|Vdc|.$$

3-2) Determination of Apparatus Charging Bias

Next, a method of determinating a charging bias at the time of image formation will be explained with reference to FIGS. 16 and 17.

Referring to FIG. 16, when the charging-bias voltage is applied to the charging roller 11, an alternating current Iac flows through a high-voltage power-supply circuit GND via the charging roller 11 and the photosensitive drum 10. At that time, an AC detection means 128 detects and selects only an alternating-current component with a frequency equal to a charging frequency from the alternating current Iac by an unshown filtering circuit, and the selected alternating-current component is converted into a corresponding voltage, which value is then inputted into the engine controller 123. Incidentally, the AC detection means 128 can be constituted by, e.g., a resistor, a capacitor and a diode, thus lessening the increase in cost and space of the power-supply circuit.

The inputted voltage inputted into the engine controller 123 is compared with a minimum voltage V0 which is a predetermined voltage whose input level is preliminarily set. Incidentally, the minimum voltage V0 is an output voltage for a minimum alternating peak-to-peak voltage without causing charge irregularity, and a value thereof is determined based on a minimum-current value Iac-0 capable of effecting uniform charging. The value of Iac-0 varies depending on the process speed of the apparatus, the charging frequency, and the materials for the charging apparatus 11 and photosensitive drum 10. For this reason, it is preferable that the minimum voltage 0 is also appropriately set in each case.

The engine controller 123 selects a minimum AC output voltage, which is at least a predetermined minimum voltage V0, as an AC output voltage from the AC oscillation output 122, i.e., selects a charging bias at the time of image formation.

Figure 18:
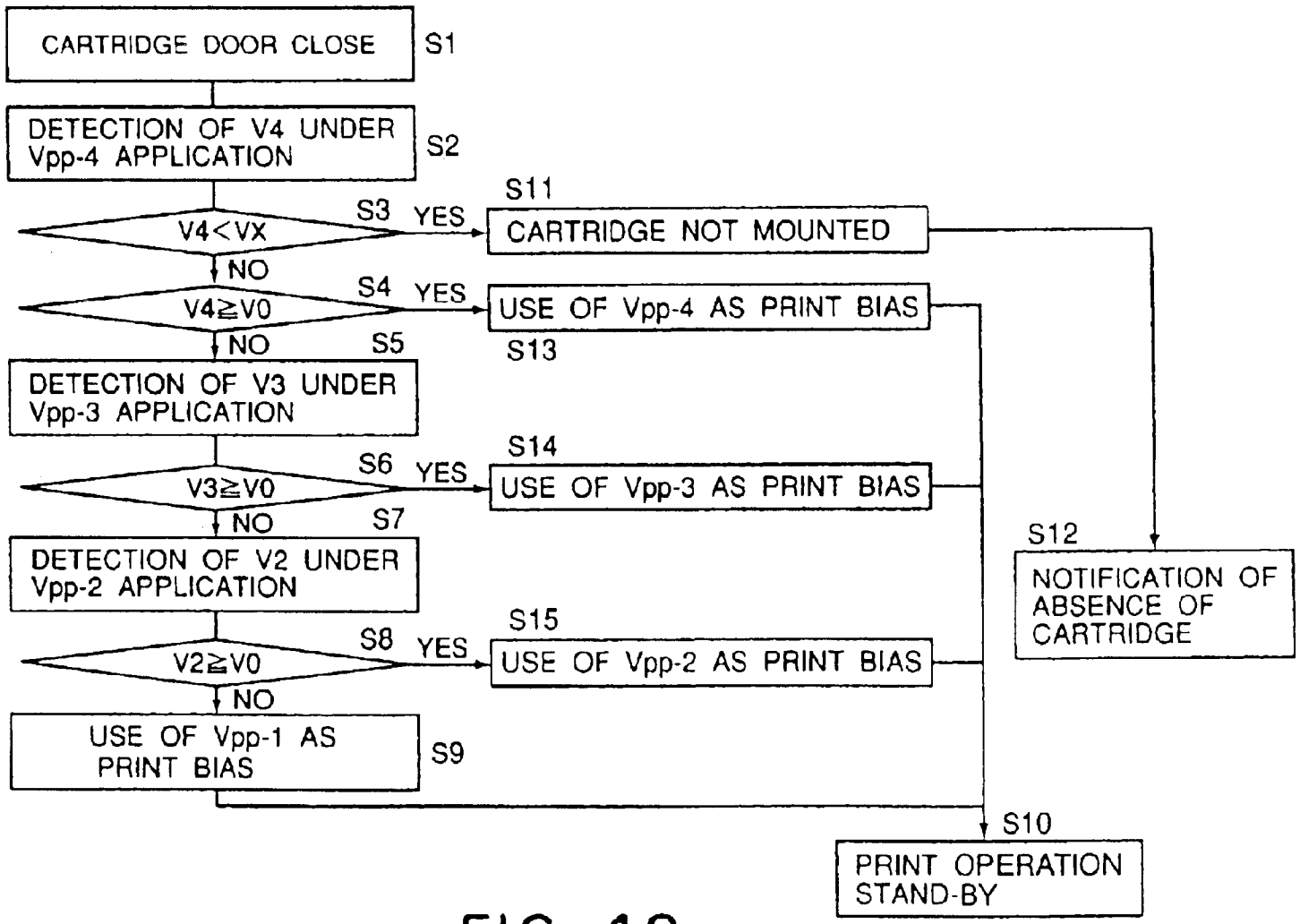
FIG. 18 is a flowchart showing a method of determining a charging bias.

Next, the procedure from the AC current detection to the charging-bias determination in this embodiment will be described with reference to a flowchart of FIG. 18. In this embodiment, the charging-bias-determination step is performed immediately after the process cartridge is mounted.

First, when the detection of a closed state of the cartridge door 18 to be opened and closed at the time of mounting the process cartridge to the image forming apparatus main body 20 is effected (Step S1), the engine controller 123 of the apparatus main body 20 first applies a lowest available peak-to-peak voltage Vpp-4.

The AC detection means detects and converts an alternating current Iac-4 passing through the photosensitive drum into a detection voltage V4 and feeds back the detection voltage V4 to the engine controller 123 (Steps S2 and S3).

If V4<Vx, wherein Vx represents the detection voltage when a reference AC value for detecting the presence and absence of the process cartridge is defined as Iac-x, it is determined that the process cartridge is not mounted and users are notified of the absence of the process cartridge (Steps S3, S11 and S12). On the other hand, if V4 is not less than Vx and if V4>V0, Vpp-4 is determined as the charging bias at the time of printing ("print(ing) bias") (Steps S4, S13 and S10).

If Vx<V4<V0, the second lowest voltage Vpp-3 is applied and a detection voltage V3 is fed back and compared with V0 (Step S5).

At this time, if V3≧V0, Vpp-3 is used as a print bias (Steps S6, S14 and S10). If V3<V0, a higher voltage Vpp-2 is applied and the resultant detection voltage V2 is attained (Step S7). If V2≧V0, V2 is used as the print bias (Steps S8, S15 and S10). If V2<V0, Vpp-l is used as the print bias (Steps S8, S9 and S10).

In this case, the output voltage V1 at the time of applying the maximum voltage Vpp-1 of the available peak-to-peak voltages is preliminarily set to satisfy V1≧V0 in any environment, whereby charge failure cannot occur in any environment. Further, the order of bias application is not necessarily identical to that shown in FIG. 8.

(4) Effects of this Embodiment will be Described with Reference to FIG. 19

In this embodiment, two species of process cartridges CA and CB have been prepared and mounted to the same image forming apparatus main body 20, followed by pre-multiple rotation. The process cartridge CA is a new one and the process cartridge CB is a used one having about half of the operation life of the new process cartridge.

The photosensitive drum 10 of the process cartridge CA has a sufficient film thickness, so that the combined capacitance thereof with the charging means 11 is small. As a result, an alternating current is hard to pass through the process cartridge CA. On the other hand, in the case of process cartridge CB, the photosensitive drum 10 is abraded by the use thereof, thus being decreased in its film thickness to increase the combined capacitance. Accordingly, the resultant alternating-current value is also increased.

Figure 19:
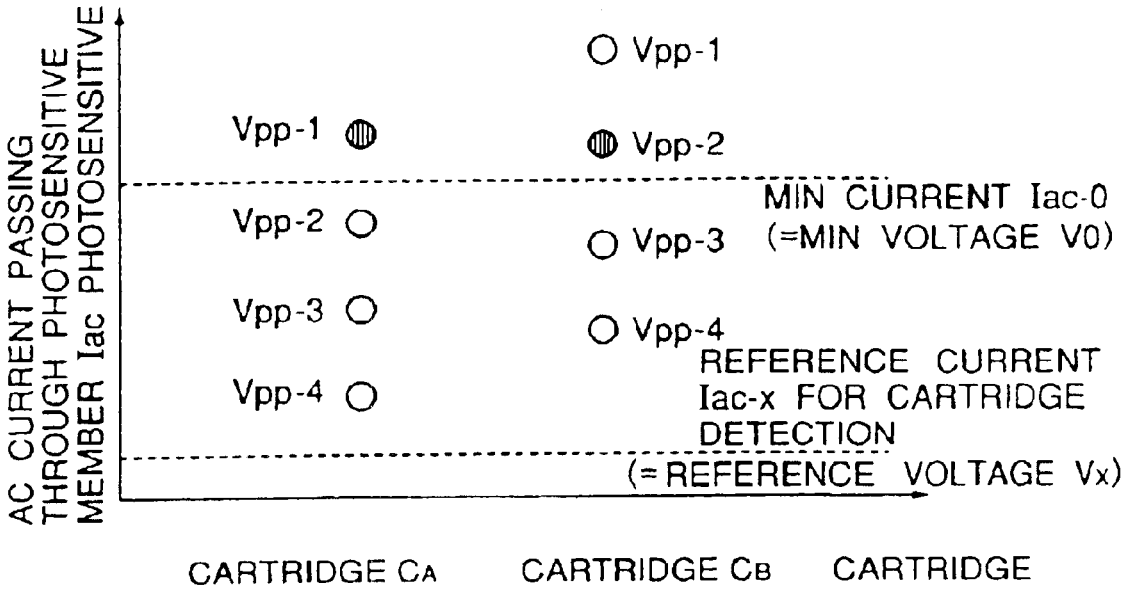
FIGS. 19 and 20 are graphs showing the effects of Embodiments 4 and 5, respectively.

When the above-described charging-bias-determination procedure is applied to the process cartridges CA and CB, the results shown in FIG. 19 are attained. Alternating-current values Iac-4A, Iac-3A and Iac-2A under the application of Vpp-4, Vpp-3 and Vpp-2, respectively, are below the current value Iac-0, causing no charging failure, and only an alternating-current value Iac-1A under the application of Vpp-1 exceeds Iac-0. Accordingly, the charging-bias voltage at the time of mounting the process cartridge CA is determined as Vpp-1.

On the other hand, although AC values Iac-4B and Iac-3B under the application of Vpp-4 and Vpp-3, respectively, are below Iac-0, AC value Iac-2B under the application of Vpp-2 exceeds Iac-0. Accordingly, it is understood that the process cartridge CB does not cause a charging failure under the, application of Vpp-2. In the case of the process cartridge CB, the charging-bias value is determined as Vpp-2.

As described above, if the detection of Iac is not performed, it is necessary to apply Vpp-1 causing no charging failure if applied to even the process cartridge CB. As a result, the amount of discharged electrical charges becomes large and there is apprehension that the photosensitive drum 10 incurs considerable damage.

In this embodiment, the case of using the different photosensitive drums 10 having different film thicknesses is described, but the case of using charging members 11 different in impedance is similarly applicable.

As described above, during the pre-multiple-rotation operation immediately after the process cartridge C is mounted, the plurality of AC charging-bias voltages are applied in a switching manner and at that time, the AC value passing through the photosensitive drum 10 and the charging member 11 is detected, whereby it is possible to determine an appropriate charging bias for the mounted process cartridge C. In this embodiment, 4 species of charging AC bias voltages are set to be applied, but it should be understood that if at least two species of the AC charging-bias voltage are applicable, such cases are also embraced in the scope of the present invention.

<Embodiment 5>

Although the description of Embodiment 4 states that the appropriate charging bias can be selected for each of the different process cartridge CA and CB, in this embodiment, the appropriate charging bias can also be selected even if different main bodies of the image forming apparatus as employed.

In Embodiment 4, the detected AC value varied depending on differences in film thickness of the photosensitive drums 10 and in impedance of the charging member 11 even under application of the same peak-to-peak voltage.

On the other hand, it is well known in the art that the charging-bias-application circuit 121 of the image forming apparatus exhibits variations to some extent. If the peak-to-peak voltage of the charging-bias-application circuit 121 varies, the resultant AC value passing through the photosensitive drum 10 and the charging member 11 also varies even when the same photosensitive drum 10 and the same charging member 11 are used.

Figure 20:
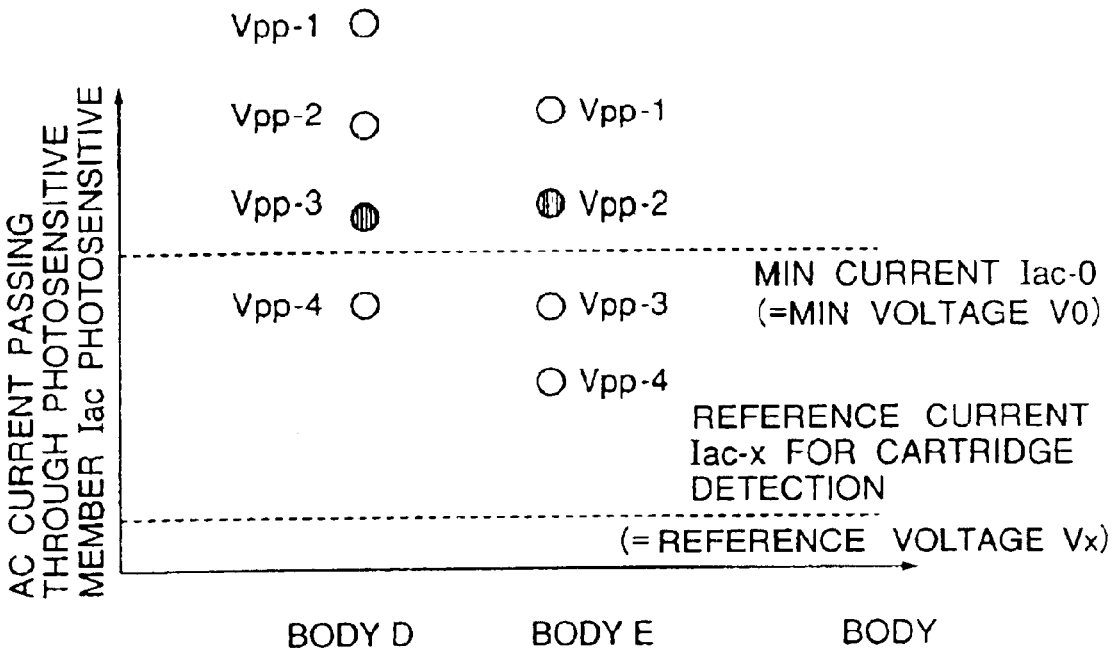

FIG. 20 shows a state in which a charging bias can be selected for each of an image forming apparatus main body D, designed for an upper limit of the charging bias, and an image forming apparatus main body E, designed for a lower limit of the charging bias while causing no charging failure and suppressing the amount of discharged electrical charges. Incidentally, the process cartridge is a used one.

Referring to FIG. 20, with respect to the main body D, an AC value Iac-4D under the application of Vpp-4 is below Iac-0 but an AC value Iac-3D exceeds Iac-0. Accordingly, it is understood that there is no problem if Vpp-3 is selected as the charging bias.

On the other hand, as for the main body E, AC values Iac-4E and Iac-3E under the application of Vpp-4 and Vpp-3, respectively, are below Iac-0. For this reason, if Vpp-3 is selected as the charging bias similarly as in the main body D, designed for the upper limit of the charging bias, the main body E, designed for the lower limit of the charging bias, causes a charging failure. When an AC value Iac-2E is measured by applying a higher voltage value Vpp-2, the measured AC value Iac-2E exceeds Iac-0. Accordingly, it is understood that it is necessary to apply Vpp-2 in the main body E designed for the lower limit of the charging bias.

As described above, in this embodiment, it is possible to adopt a lower peak-to-peak voltage causing no charging failure in both of the main bodies D and E. As a result, it becomes possible to apply an appropriate bias-voltage value irrespective of variations of the image formation apparatus main body.

<Miscellaneousness>

1) The shape of the contact-charging member 11 is not limited to the roller shape but may be, e.g., an endless belt shape. Further, the contact-charging member may be used in the form of fur brush, felt, cloth, etc., in addition to the charging roller. It is also possible to provide an appropriate elasticity (flexibility) and electroconductivity to the charging member 11 by lamination. Further, the charging member 11 can be modified into a charging blade, a magnetic brush-type charging member, etc.

2) The exposure means for forming the electrostatic latent image is not restricted to the laser-beam scanning-exposure means 12 for forming a latent image in a digital manner but may be other means, such as an ordinary analog-image exposure means and light-emitting devices including an LED. It is possible to apply any means capable of forming an electrostatic latent image corresponding to image data, such as a combination of the light-emitting device, such a fluorescent lamp, with a liquid crystal shutter.

3) The latent image bearing member 10 may, e.g., be an electrostatic recording dielectric body. In this case, the surface of the dielectric body is primary-charged uniformly to a predetermined polarity and a predetermined potential and then is charge-removed selectively by charge-removing means, such as a charge-removing-needle head or an electron gun, thereby to form an objective electrostatic latent image by writing.

4) The developing apparatus 13 used in the above-mentioned embodiments is of a reversal-development type but is not limited thereto. A normal development-type developing apparatus is also applicable.

Generally, the developing method of the electrostatic latent image may be roughly classified into four types including: a monocomponent non-contact-development method in which a toner coated on a developer-carrying member, such as a sleeve with a blade, etc., for a non-magnetic toner or coated on a developer-carrying member by the action of magnetic force for a magnetic toner, is carried and applied onto the image bearing member in a non-contact state to develop an electrostatic latent image; a mono-component contact-developing method, in which the toner coated on the developer-carrying member in the above-mentioned manner is applied onto the image bearing member in a contact state to develop the electrostatic latent image; a two-component contact-developing method in which a two-component developer prepared by mixing toner particles with a magnetic carrier is carried and applied onto the image bearing member in a contact state to develop the electrostatic latent image; and a two-component non-contact-development method in which the two-component developer is applied onto the image-bearing member in a non-contact state to develop the electrostatic latent image.

To the present invention, the four types of developing methods are applicable.

5) The transfer means 15 is not restricted to the transfer roller but may be modified into transfer means using a belt, a corona discharge, etc. Further, it is also possible to employ an intermediate transfer member (a member to be temporarily transferred) such as a transfer drum or a transfer belt, for use in an image forming apparatus for forming multicolor or full-color images by a multiple-transfer operation, in addition to a monochromatic image.

6) As a waveform of an AC voltage component of the bias applied to the charging member 11 or the developer-carrying member 13-*c* (i.e., an AC component which is a voltage having a periodically varying voltage value), it is possible to adopt a sinusoidal wave, a rectangular wave and a triangular wave. Further, the AC voltage may comprise a rectangular wave formed by turning a DC power supply on and off periodically.

Furthermore, the present invention is not limited to the above-described embodiments, and variations and modifications may be made within the scope of the present invention.

What is claimed is:

1. A charging apparatus, comprising:

a charging member, contactable to a member to be charged during first and second times, wherein said charging member is configured and positioned to charge the member to be charged, a voltage application device configured and positioned to be capable of applying first alternating voltages having different first peak-to-peak voltages to said charging member when said charging member contacts, during the first time, the member to be charged, wherein an alternating current passing through the member to be charged in response to each first alternating voltage applied to said charging member is detectable, and a determination device configured and positioned to determine a second peak-to-peak voltage to be applied to said charging member on the basis of a peak-to-peak voltage corresponding to a minimum current, said second peak-to-peak voltage being applied to said charging member when said charging member contacts, during the second time, the member to be charged, wherein the minimum current is not less than a predetermined current, and is the lowest alternating current of alternating currents passing through the member to be charged when the first alternating voltages are applied to said charging member.

2. An apparatus according to claim 1, wherein said voltage application device comprises a single voltage increase device that outputs a superposed voltage comprising an AC voltage and a DC voltage.

3. An apparatus according to claim 2, wherein the different peak-to-peak voltages of the first alternating voltages include a minimum peak-to-peak AC voltage denoted by Vpp-min and a DC voltage is denoted by Vdc, and wherein the following relationship is satisfied:

$$Vpp\text{-}min/2 \geqq |Vdc|.$$

4. An apparatus according to claim 1, wherein the different peak-to-peak voltages of the first alternating voltages are successively applied in ascending order until said determination device determines the second peak-to-peak voltage.

5. An apparatus according to claim 1, wherein the alternating current passing through the member to be charged when a maximum peak-to-peak voltage of the first alternating voltages is applied, is not less than the predetermined current.

6. An apparatus according to claim 1, further comprising a detector configured and positioned to detect the alternating current.

7. An apparatus according to claim 1, wherein the member to be charged is an image bearing member, and the second time is an image forming time for forming an image on the image bearing member.

8. An apparatus according to claim 7, wherein said peak-to-peak voltages include alternating voltages that are denoted by Vpp-n, and Vpp-(n+1) in descending order, wherein n is natural number, wherein Vpp-n is applied to said charging member during the second time and Vpp-(n+1) is applied to said charging member during the first time, wherein the voltage applied to said charging member during the second time when the alternating current passing through the member to be charged during the first time is smaller than the predetermined current, is kept at Vpp-n, and wherein the voltage applied to said charging member during the second time when the alternating current passing through the member to be charged during the first time is not less than the predetermined current, is changed to Vpp-(n+1).

9. An apparatus according to claim 1, wherein said charging member satisfies the following relationship:

$$0.1 \leqq R\text{-}low/R\text{-}high \leqq 10,$$

wherein R-low represents the electrical resistance of said charging member in an environment having a temperature of 10° C. and a humidity of 10%, and R-high represents the electrical resistance of said charging member in an environment having a temperature of 35° C. and a humidity of 85%.

10. An apparatus according to claim 1, wherein the member to be charged is an image bearing member for carrying an image, and the image bearing member and said charging member are provided in a process cartridge detachably mountable to a main body of an image forming apparatus.

11. An apparatus according to claim 10, wherein said voltage application device determines the second peak-to-peak voltage during an interval from when the process cartridge is mounted to the main body of the image forming apparatus to when the image forming apparatus enters and is maintained in a stand-by state.

12. An apparatus according to claim 1, wherein the member to be charged is an image bearing member, wherein the second time is an image forming time for forming an image on the image bearing member, and wherein the first time is a non-image forming time.

13. An apparatus according to claim 12, wherein said charging member charges the image bearing member with the second peak-to-peak voltage only when an image forming operation is being performed on the image bearing member.

* * * * *

UNITED STATES PATENT AND TRADEMARK OFFICE

CERTIFICATE OF CORRECTION

PATENT NO. : 6,882,806 B2
APPLICATION NO. : 10/405467
DATED : April 19, 2005
INVENTOR(S) : Satoshi Sunahara et al.

It is certified that error appears in the above-identified patent and that said Letters Patent is hereby corrected as shown below:

Column 16,
Line 20, "case" should read --case of--.
Line 21, "of" (first occurrence) should be deleted.

Column 17,
Line 29, "the" (first occurrence) should be deleted.

Column 22,
Line 17, "is" should read --is a--.

Signed and Sealed this

Eleventh Day of July, 2006

JON W. DUDAS
*Director of the United States Patent and Trademark Office*